US009779677B2

(12) United States Patent
Igawa

(10) Patent No.: US 9,779,677 B2
(45) Date of Patent: Oct. 3, 2017

(54) DISPLAY APPARATUS AND METHOD OF DRIVING THE SAME THAT COMPENSATES TEMPERATURE VARIATIONS IN THE DISPLAY APPARATUS

(71) Applicant: SAMSUNG DISPLAY CO., LTD., Yongin, Gyeonggi-Do (KR)

(72) Inventor: Masami Igawa, Suwon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 53 days.

(21) Appl. No.: 14/660,467

(22) Filed: Mar. 17, 2015

(65) Prior Publication Data

US 2016/0027412 A1 Jan. 28, 2016

(30) Foreign Application Priority Data

Jul. 23, 2014 (KR) ..... 10-2014-0093341

(51) Int. Cl.
*G09G 3/36* (2006.01)

(52) U.S. Cl.
CPC ..... *G09G 3/3648* (2013.01); *G09G 2320/029* (2013.01); *G09G 2320/0285* (2013.01); *G09G 2320/041* (2013.01)

(58) Field of Classification Search
CPC ..... G09G 3/3648; G09G 2320/041; G09G 2320/029; G09G 2320/0285
See application file for complete search history.

(56) References Cited

U.S. PATENT DOCUMENTS

| | | | | |
|---|---|---|---|---|
| 7,542,021 | B2 | 6/2009 | Kim et al. | |
| 7,825,885 | B2 | 11/2010 | Sato et al. | |
| 7,864,172 | B2 | 1/2011 | Miyake et al. | |
| 7,973,782 | B2 | 7/2011 | Itakura et al. | |
| 8,599,122 | B2 | 12/2013 | Shin et al. | |
| 2004/0169629 | A1* | 9/2004 | Lee | G09G 3/2011 345/95 |
| 2005/0184940 | A1* | 8/2005 | Oh | G09G 3/3614 345/87 |
| 2006/0066553 | A1* | 3/2006 | Deane | G09G 3/3648 345/98 |
| 2007/0024560 | A1* | 2/2007 | Kim | G09G 3/3614 345/94 |

(Continued)

FOREIGN PATENT DOCUMENTS

| | | |
|---|---|---|
| JP | 2000-111947 | 4/2000 |
| JP | 2000-250416 | 9/2000 |

(Continued)

*Primary Examiner* — Ryan A Lubit
(74) *Attorney, Agent, or Firm* — F. Chau & Associates, LLC

(57) ABSTRACT

A display apparatus includes a display panel that includes pixels for receiving data voltages in response to gate signals, and dummy pixels, a driver for driving the pixels and the dummy pixels, a kickback voltage detector for detecting a kickback voltage of the dummy pixels, and a timing controller. The timing controller calculates a temperature corresponding to the kickback voltage, compares the calculated temperature with a reference temperature, and controls the driver to compensate a display panel image quality based on a temperature variation that corresponds to a difference between the calculated temperature and the reference temperature.

20 Claims, 18 Drawing Sheets

(56) References Cited

U.S. PATENT DOCUMENTS

| | | | | |
|---|---|---|---|---|
| 2007/0076136 | A1* | 4/2007 | Matsuda | G09G 3/3648 349/43 |
| 2007/0188430 | A1* | 8/2007 | Moon | G09G 3/3648 345/89 |
| 2009/0058780 | A1 | 3/2009 | Fukano et al. | |
| 2009/0066627 | A1 | 3/2009 | Yin | |
| 2009/0147164 | A1 | 6/2009 | Toyoshima et al. | |
| 2013/0082994 | A1* | 4/2013 | Al-Dahle | G09G 3/3648 345/208 |
| 2013/0293526 | A1 | 11/2013 | Igawa | |
| 2014/0104155 | A1* | 4/2014 | Long | G09G 3/344 345/107 |
| 2014/0111499 | A1* | 4/2014 | Jang | G09G 3/3696 345/212 |
| 2015/0116373 | A1 | 4/2015 | Kim et al. | |
| 2016/0005364 | A1* | 1/2016 | Kobayashi | G09G 3/3648 345/206 |
| 2016/0005365 | A1 | 1/2016 | Choi et al. | |

FOREIGN PATENT DOCUMENTS

| | | |
|---|---|---|
| JP | 2000-305063 | 11/2000 |
| JP | 3361265 | 1/2003 |
| JP | 2006-018170 | 1/2006 |
| JP | 2009-186682 | 8/2009 |
| JP | 2010-197928 | 9/2010 |
| KR | 10-2003-0088575 | 11/2003 |
| KR | 10-2004-0087400 | 10/2004 |
| KR | 10-2005-0113477 | 12/2005 |
| KR | 10-2007-0074792 | 1/2006 |
| KR | 10-2006-0119269 | 11/2006 |
| KR | 10-0672654 | 1/2007 |
| KR | 10-2009-0080269 | 7/2009 |
| KR | 10-1016279 | 2/2011 |
| KR | 10-2011-0075476 | 7/2011 |
| KR | 10-2013-0123998 | 11/2013 |
| KR | 10-2015-0022160 . | 3/2015 |

* cited by examiner

DISPLAY APPARATUS AND METHOD OF DRIVING THE SAME THAT COMPENSATES TEMPERATURE VARIATIONS IN THE DISPLAY APPARATUS

CROSS-REFERENCE TO RELATED APPLICATION

This U.S. non-provisional patent application claims priority under 35 U.S.C. §119 from Korean Patent Application No. 10-2014-0093341, filed on Jul. 23, 2014 in the Korean Intellectual Property Office, and all the benefits accruing therefrom, the contents of which are herein incorporated by reference in their entirety.

BACKGROUND

1. Technical Field

Embodiments of the present disclosure are directed to a display apparatus and a method of driving the same. More particularly, embodiments of the present disclosure are directed to a display apparatus having improved display quality and a method of driving the display apparatus.

2. Discussion of the Related Art

In general, a liquid crystal display includes a first substrate, a second substrate facing the first substrate, and a liquid crystal layer interposed between the first and second substrates. The first substrate may include pixels to drive the liquid crystal layer. The pixels include pixel electrodes. The second substrate may include a common electrode.

An electric field is formed between the pixel electrodes and the common electrode by data voltages applied to the pixel electrodes and a common voltage applied to the common electrode. Due to the electric field formed between the pixel electrodes and the common electrode, the transmittance of light passing through the liquid crystal layer is controlled, and thus a desired image may be displayed.

When the temperature of a display panel changes while the display panel is operated, the display quality of an image displayed on the display panel may deteriorate. For example, when the temperature of a display panel changes, driving characteristics of semiconductor devices disposed on the display panel, such as the thin film transistors, and the dielectric constant of the liquid crystal layer may vary.

In this case, a gamma voltage, which is initially set, no longer corresponds to the variation in the driving characteristics of the thin film transistors. In addition, when the dielectric constant of the liquid crystal layer varies, a kickback voltage of the thin film transistor changes. As a result, a flicker phenomenon may occur.

SUMMARY

Embodiments of the present disclosure may provide a display apparatus with improved display quality.

Embodiments of the present disclosure can provide a method of driving the display apparatus.

Embodiments of the inventive concept provide a display apparatus that includes a display panel that includes a plurality of pixels for receiving data voltages in response to gate signals and a plurality of dummy pixels, a driver for driving the pixels and the dummy pixels, a kickback voltage detector for detecting a kickback voltage from the dummy pixels, and a timing controller for calculating a temperature corresponding to the kickback voltage, comparing the calculated temperature with a reference temperature, and controlling the driver to compensate for the display panel image quality based on a temperature variation that corresponds to a difference between the calculated temperature and the reference temperature.

The display panel includes a liquid crystal layer disposed between two substrates. The driver includes a gate driver that transmits the gate signals to the pixels and the dummy pixels, a data driver that generates the data voltages using image signals and a gamma voltage and transmits the data voltages to the pixels and the dummy pixels, a gamma voltage generator that transmits the gamma voltage to the data driver, and a common voltage supply that transmits a common voltage to the pixels and the dummy pixels. The timing controller includes a look-up table for storing temperature values that correspond to a variation in a dielectric constant of the liquid crystal layer, calculates the temperature corresponding to the kickback voltage using the look-up table, controls the gamma voltage generator and the common voltage supply to compensate the gamma voltage and the common voltage based on the temperature variation, converts the image signals based on the temperature variation, and transmits the converted image signals to the data driver.

The display panel further includes a plurality of gate lines connected to the pixels and the dummy pixels for receiving the gate signals, and a plurality of data lines connected to the pixels and the dummy pixels for receiving the data voltages.

The dummy pixels may include a plurality of first dummy pixels disposed in one first line extending in a first direction in a first dummy pixel area, the first dummy pixel area being disposed adjacent to a first side of a display area in which the pixels are disposed, a plurality of second dummy pixels disposed in one second line extending in a second direction perpendicular to the first direction in a second dummy pixel area, the second dummy pixel area being disposed adjacent to a second side of the display area perpendicular to the first side, and a black matrix disposed in the first and second dummy pixel areas to block light. The pixels and the first and second dummy pixels may have a same configuration and have a same kickback voltage. The gate lines may include a plurality of first gate lines connected to the pixels, a first dummy gate line connected to the first dummy pixels, and a second dummy gate line connected to the second dummy pixels. The data lines may include first data lines connected to the pixels and the second dummy pixels and a dummy data line connected to the first dummy pixels. The first gate lines may receive sequentially transmitted gate signal, and the first and second dummy gate lines may receive the gate signals with a same timing.

Each of the first and second dummy pixels may include a dummy transistor and a dummy liquid crystal capacitor connected to the dummy transistor. A dummy pixel voltage charged in the dummy liquid crystal capacitor is transmitted to the kickback voltage detector through a dummy output line, and the kickback voltage detector detects a kickback voltage from the dummy pixel voltage.

The dummy transistor of the first dummy pixel may include a dummy gate electrode connected to the first dummy gate line, a dummy source electrode connected to the dummy data line, and a dummy drain electrode connected to the dummy liquid crystal capacitor. The dummy drain electrodes may be connected to each other and to the dummy output line.

The dummy transistor of the second dummy pixel may include a dummy gate electrode connected to the second dummy gate line, a dummy source electrode connected to a corresponding first data line, and a dummy drain electrode connected to the dummy liquid crystal capacitor. The dummy drain electrodes may be connected to each other and to the dummy output line.

The dummy liquid crystal capacitor may include a dummy pixel electrode connected to the dummy drain electrode to receive a corresponding data voltage, a common electrode disposed to face the dummy pixel electrode to receive the common voltage, and a liquid crystal layer disposed between the dummy pixel electrode and the common electrode.

The dummy pixels may include a plurality of first dummy pixels disposed in a first dummy pixel area that extend in a first direction and a plurality of second dummy pixels disposed in second dummy pixel areas that extend in a second direction perpendicular to the first direction where that the first dummy pixel area is disposed between the second dummy pixel areas, and the first and second dummy pixel areas are arranged in a cross shape. A display area, in which the pixels are disposed, is divided into four areas by the first and second dummy pixel areas, the first dummy pixels are arranged in one first line, and the second dummy pixels are arranged in one second line perpendicular to the first line.

The gate lines may receive sequentially transmitted gate signals. The gate lines may include a plurality of first gate lines connected to the pixels, a first dummy gate line connected to the first dummy pixels, and a second dummy gate line connected to the second dummy pixels. The data lines may include first data lines connected to the pixels and a dummy data line connected to the second dummy pixels. The first dummy pixels may be connected to corresponding first data lines and a corresponding dummy data line.

Each of the first dummy pixels may include a first dummy transistor and a first dummy liquid crystal capacitor connected to the first dummy transistor. Each of the second dummy pixels may include a second dummy transistor and a second dummy liquid crystal capacitor connected to the second dummy transistor. A capacitance of each of the first and second dummy liquid crystal capacitors may be smaller than a capacitance of a liquid crystal capacitor of each of the pixels.

A first dummy pixel voltage charged in the first dummy liquid crystal capacitor may be transmitted to the kickback voltage detector through a first dummy output line, and a second dummy pixel voltage charged in the second dummy liquid crystal capacitor may be transmitted to the kickback voltage detector through a second dummy output line. The kickback voltage detector may detect a first kickback voltage from the first dummy pixel voltage and a second kickback voltage from the second dummy pixel voltage and outputs an average value of the first and second kickback voltages as the kickback voltage, where the first and second kickback voltages may be each greater than the kickback voltage of each of the pixels.

The first dummy transistor may include a first dummy gate electrode connected to the first dummy gate line, a first dummy source electrode connected to a corresponding data line and the dummy data line, and a first dummy drain electrode connected to the first dummy liquid crystal capacitor. The first dummy liquid crystal capacitor may include a first dummy storage electrode disposed on a same layer as the first dummy gate electrode that branches from a dummy storage line and connects to the first dummy drain electrode, a common electrode disposed to face the first dummy storage electrode that receives a common voltage, and a liquid crystal layer disposed between the first dummy storage electrode and the common electrode. The first dummy storage electrode may receive a corresponding data voltage through the first dummy transistor, and the first dummy drain electrodes may be commonly connected to the first dummy output line to be connected to each other.

The second dummy transistor may include a plurality of second sub-dummy transistors. Each of the second sub-dummy transistors may include a second dummy gate electrode connected to the second dummy gate line, a second dummy source electrode connected to the second dummy data line, and a second dummy drain electrode connected to the second dummy liquid crystal capacitor. The second dummy liquid crystal capacitor may include a dummy liquid crystal electrode that branches from the second dummy drain electrode, a common electrode disposed to face the dummy liquid crystal electrode and configured to receive a common voltage, and a liquid crystal layer disposed between the first dummy storage electrode and the common electrode. The second dummy drain electrodes may be connected to each other and to the second dummy output line.

The first dummy transistor may further include a first-first sub-dummy transistor and a first-second sub-dummy transistor. Each of the first-first and first-second sub-dummy transistors may include a first dummy gate electrode connected to the first dummy gate line, a first dummy source electrode that branches from a corresponding data line of two adjacent data lines, and a first dummy drain electrode that connects to the first dummy liquid crystal capacitor. The first dummy liquid crystal capacitor may include a first dummy storage electrode disposed on a same layer as the first dummy gate electrode and that branches from a dummy storage line and connects to the first dummy drain electrode, a common electrode disposed to face the first dummy storage electrode and configured to receive a common voltage, and a liquid crystal layer disposed between the first dummy storage electrode and the common electrode. The first dummy storage electrode may receive a corresponding data voltage through the first dummy transistor, and the first dummy drain electrodes may be connected to each other and to the first dummy output line.

Embodiments of the inventive concept provide a method of driving a display apparatus that includes receiving data voltages in response to gate signals to drive a plurality of pixels and a plurality of dummy pixels disposed on a display panel, detecting a kickback voltage from the dummy pixels, calculating a temperature that corresponds to the kickback voltage, comparing the calculated temperature with a reference temperature, and driving the pixels to compensate for a display panel image quality based on a temperature variation corresponding to a difference between the calculated temperature and the reference temperature.

The display apparatus includes a liquid crystal layer disposed between two substrates. Driving the pixels and the dummy pixels includes generating the data voltages using image signals and a gamma voltage, transmitting the data voltages to the pixels and the dummy pixels, and transmitting a common voltage to the pixels and the dummy pixels. Calculating the temperature corresponding to the kickback voltage includes using a look-up table that stores temperature values corresponding to a variation in a dielectric constant of the liquid crystal layer. Driving the pixels includes compensating the gamma voltage and the common voltage based on the temperature variation, converting the image signals, and transmitting the converted image signals to the pixels.

Embodiments of the inventive concept provide a display apparatus that includes a display panel that comprises a plurality of pixels, a plurality of dummy pixels, and a liquid crystal layer disposed between two substrates; a driver configured to generate data voltages using image signals and a gamma voltage and transmit the data voltages and a common voltage to the pixels and the dummy pixels; and a timing controller configured to calculate a temperature of the liquid crystal layer, compare the calculated temperature with a reference temperature to calculate a temperature variation, compensate the gamma voltage and the common voltage based on the temperature variation, convert the image signals based on the temperature variation, and transmit the converted image signals to the driver.

The display apparatus further includes a gate driver that applies the gate signals to the pixels and the dummy pixels, wherein the plurality of pixels are configured to receive data voltages in response to gate signals, and a kickback voltage detector configured to detect a kickback voltage from the dummy pixels, wherein the kickback voltage corresponds to a dielectric constant of the liquid crystal layer, and the dielectric constant corresponds to the temperature of the liquid crystal layer. The driver includes a data driver that generates the data voltages using image signals and the gamma voltage and transmits the data voltages to the pixels and the dummy pixels, a gamma voltage generator that transmits the gamma voltage to the data driver, and a common voltage supply that transmits the common voltage to the pixels and the dummy pixels. The timing controller includes a look-up table configured to store temperature values that correspond to a variation in the dielectric constant of the liquid crystal layer, calculates the temperature corresponding to the kickback voltage using the look-up table, and controls the gamma voltage generator and the common voltage supply to compensate the gamma voltage and the common voltage based on the temperature variation.

According to the above, a display apparatus and driving method of the display apparatus may compensate for display quality variations e caused by the temperature variations, which may improve the display quality of the display apparatus.

DETAILED DESCRIPTION

It will be understood that when an element or layer is referred to as being "on", "connected to" or "coupled to" another element or layer, it can be directly on, connected or coupled to the other element or layer or intervening elements or layers may be present. Like numbers may refer to like elements throughout.

Hereinafter, exemplary embodiments of the present disclosure will be explained in detail with reference to the accompanying drawings.

Figure 1:
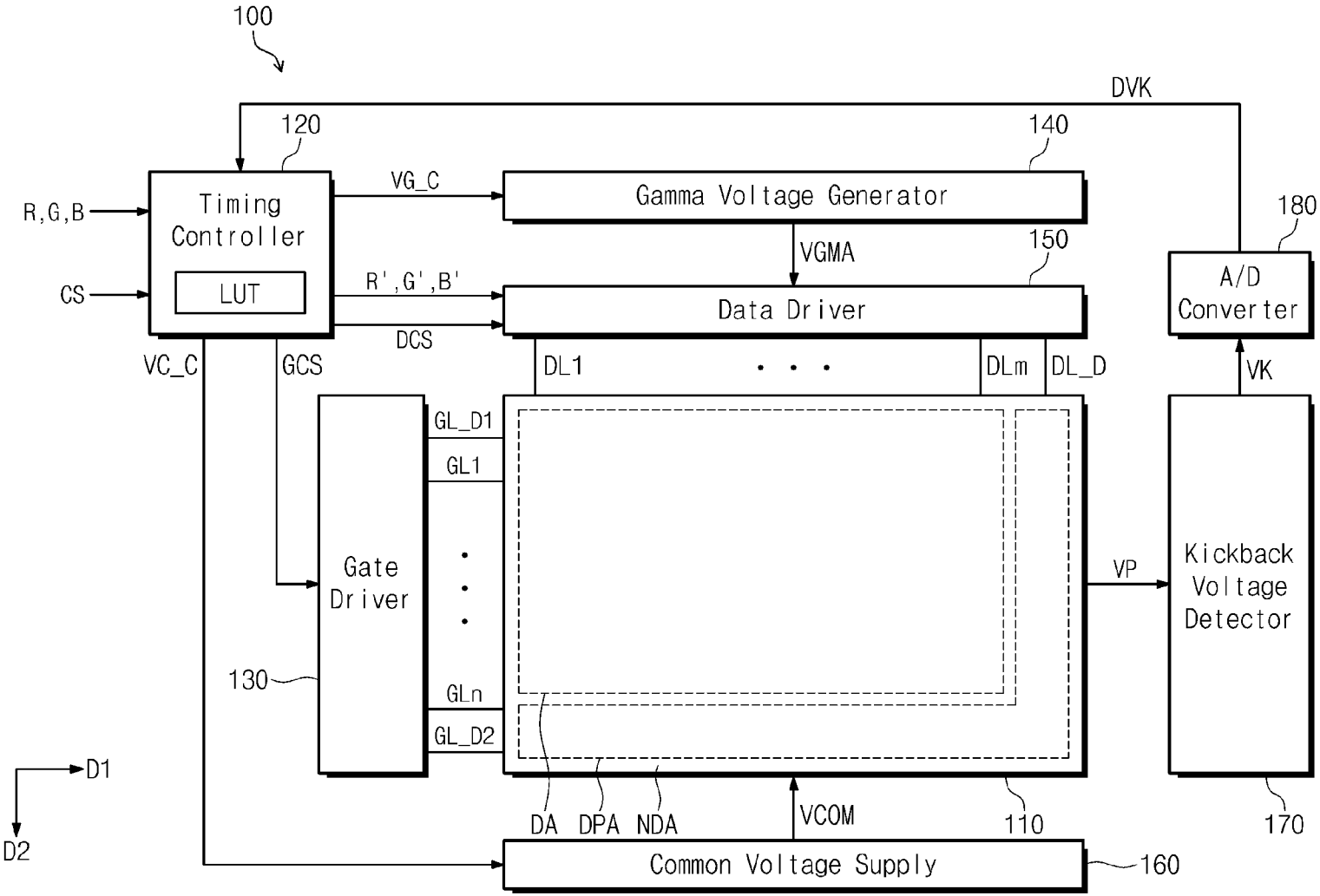
FIG. 1 is a block diagram of a display apparatus according to an exemplary embodiment of the present disclosure.
Figure 2:
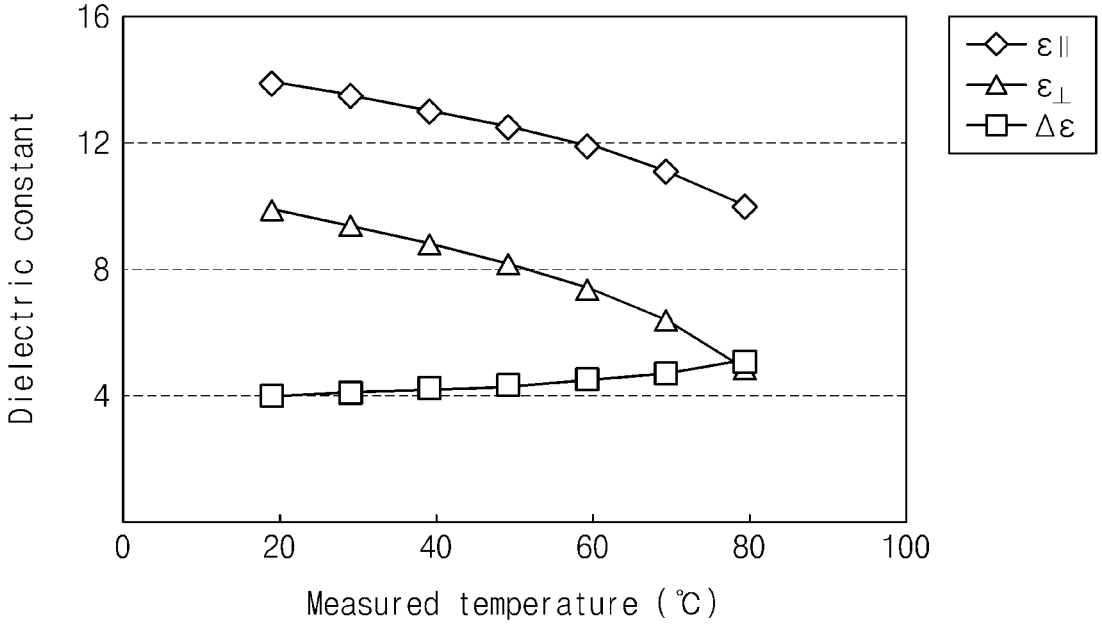
FIG. 2 is a graph of the variation of the dielectric constant of a liquid crystal layer as a function of the variation in temperature.

FIG. 1 is a block diagram of a display apparatus 100 according to an exemplary embodiment of the present disclosure and FIG. 2 is a graph of the variation in dielectric constant of a liquid crystal layer as a function of the variation in temperature.

Referring to FIG. 1, the display apparatus 100 includes a display panel 110, a timing controller 120, a gate driver 130, a gamma voltage generator 140, a data driver 150, a common voltage supply 160, a kickback voltage detector 170, and an analog-to-digital converter 180 (hereinafter, referred to as A/D converter).

The display panel 110 is a liquid crystal display panel. The gate driver 130, the gamma voltage generator 140, the data driver 150, the common voltage supply 160, the kickback voltage detector 170, and the A/D converter 180 may be referred to as a driving part to drive the display panel 110.

The display panel 110 includes a display area DA in which an image is displayed and a non-display area NDA disposed in the vicinity of the display area DA, in which no image is displayed. A dummy pixel area DPA is disposed in the non-display area NDA. In detail, the dummy pixel area DPA may surround two sides, such as a lower side and a right side, of the display area DA when viewed in a plan view.

The gate driver 130 may be connected to a left side of the display panel 110 and the data driver 150 may be connected to an upper side of the display panel 110.

The display area DA includes a plurality of pixels and the dummy pixel area DPA includes a plurality of dummy pixels. The arrangements of the pixels and the dummy pixels will be described in detail below with reference to FIG. 2.

Gate lines GL_D1, GL1 to GLn, and GL_D2 extend in a first direction D1 and are connected to the pixels and the dummy pixels. The first direction D1 may correspond to a row direction. In a present exemplary embodiment, "n" is an integer greater than zero. The gate lines GL_D1, GL1 to GLn, and GL_D2 are connected to the gate driver 130 and receive gate signals from the gate driver 130.

The gate lines GL_D1, GL1 to GLn, and GL_D2 may include a plurality of first gate lines GL1 to GLn connected to the pixels and a plurality of dummy gate lines GL_D1 and GL_D2 connected to the dummy pixels.

Data lines DL1 to DLm and DL_D extend in a second direction D2 that crosses the first direction D1 and are connected to the pixels and the dummy pixels. In a present exemplary embodiment, "m" is an integer greater than zero. The second direction D2 may correspond to a column direction. The data lines DL1 to DLm and DL_D are connected to the data driver 150 and receive analog data voltages from the data driver 150.

The data lines DL1 to DLm and DL_D may include a plurality of first data lines DL1 to DLm and a dummy data line DL_D. The first data lines DL1 to DLm are connected to the pixels. The dummy pixels may be connected to the first data lines DL1 to DLm or the dummy data line DL_D, based on their arrangement positions.

The connections of the pixels and the dummy pixels with respect to the gate lines GL_D1, GL1 to GLn, and GL_D2 and the data lines DL1 to DLm and DL_D will be described in detail with reference to FIG. 3.

The timing controller 120 can receive image signals R, G, and B and a control signal CS from an external system, such as a system board. The timing controller 120 converts the data format of the image signals R, and B into a format appropriate to an interface between the timing controller 120 and the data driver 150. The timing controller 120 transmits the converted format image signals R', G', and B' to the data driver 150.

The timing controller 120 generates a gate control signal GCS and a data control signal DCS in response to the control signals CS. The gate control signal GCS can control an operation timing of the gate driver 130. The data control signal DCS can control an operation timing of the data driver 150. The timing controller 120 transmits the gate control signal GCS to the gate driver 130 and the data control signal DCS to the data driver 150.

The gate driver 130 outputs gate signals in response to the gate control signal GCS. The gate signals are sequentially transmitted by the first gate lines GL1 to GLn. The gate signals are transmitted to the pixels row-by-row through the first gate lines GL1 to GLn.

The dummy gate lines GL_D1 and GL_D2 receive the gate signals with the same timing. Gate signals with the same timing are transmitted to the dummy pixels through the dummy gate lines GL_D1 and GL_D2.

The gamma voltage generator 140 generates gamma voltages VGMA to covert the image signals R', G', and B' into analog data voltages. The gamma voltage generator 140 transmits the gamma voltages VGMA to the data driver 150.

The data driver 150 generates the data voltages in response to the data control signal DCS. In detail, the data driver 150 generates analog data voltages using the image signals R', G', and B' and the gamma voltages VGMA. The data voltages are transmitted to the pixels and dummy pixels through the data lines DL1 to DLm and DL_D.

The common voltage supply 160 generates a common voltage VCOM and transmits the common voltage VCOM to the pixels and the dummy pixels.

The pixels receive the data voltages through the first data lines DL1 to DLm in response to gate signals received through the first gate lines GL1 to GLn. The pixels are charged with pixel voltages corresponding to the data voltages, so that the pixels may display an image. In substance, the pixels are charged by a voltage difference between the data voltages and the common voltage VCOM.

The dummy pixels receive the data voltages through the data lines DL1 to DLm and DL_D in response to the gate signals received through the dummy gate lines GL_D1 and GL_D2. The data voltages received by the dummy pixels may have the same value.

To prevent the image from being displayed in the dummy pixel area DPA, a black matrix may be disposed in the dummy pixel area DPA to block light.

The kickback voltage detector 170 detects a kickback voltage VK in the dummy pixels that are driven. The kickback voltage detector 170 transmits the kickback voltage VK to the A/D converter 180. The A/D converter 180 converts the kickback voltage VK to a digital signal DVK. The digital kickback voltage DVK is transmitted to the timing controller 120.

The timing controller 120 calculates the temperature of the display panel 110 using the kickback voltage VK. A method of calculating the temperature of the display panel 110 using the kickback voltage VK is as follows.

The liquid crystals in the liquid crystal layer have an inherent dielectric constant based on the type of the liquid crystals. The dielectric constant of the liquid crystals varies depending on the temperature. The liquid crystals whose dielectric constant is shown in FIG. 2 are ZLI-2293, which is manufactured by Merck and Co.

Referring to FIG. 2, the dielectric constant of the liquid crystals varies depending on the temperature. The dielectric constant of the liquid crystals includes a horizontal dielectric constant ($\in\|$) when liquid crystal molecules are aligned in a direction substantially parallel to a substrate, a vertical dielectric constant ($\in\perp$) when the liquid crystal molecules are aligned in a direction substantially vertical to the substrate, and a difference dielectric constant ($\Delta\in$) between the horizontal dielectric constant ($\in\|$) and the vertical dielectric constant ($\in\perp$), all of which vary depending on the temperature. This is because an order parameter changes.

Referring to FIG. 1 again, referring to the temperature at which the display panel 110 normally displays the image as a reference temperature, the display quality of the display apparatus 100 deteriorates when the temperature of the display panel 110 differs from the reference temperature.

When the temperature of the display panel 110 changes, the dielectric constant of the liquid crystal layer changes in accordance with the temperature variation. When the dielectric constant of the liquid crystal layer changes, the kickback voltage VK changes.

That is, the variation in the dielectric constant of the liquid crystal layer corresponds to the variation in the temperature of the display panel 110, and the variation in the kickback voltage VK corresponds to the variation in the dielectric constant of the liquid crystal layer LC. Accordingly, the temperature of the liquid crystal layer may be calculated using the detected kickback voltage VK.

The timing controller 120 includes a look-up table LUT in which temperature values that correspond to the variation in the dielectric constant of the liquid crystal layer and kickback voltages that correspond to the temperature values are stored. The timing controller 120 receives the kickback voltage DVK and calculates the temperature value corresponding to the kickback voltage DVK using the look-up table LUT. As a result, the temperature of the display panel 110 may be measured.

When a thermometer is disposed on the outside of the display panel 110, the temperature of the display panel 110 may not be precisely measured due to external environmental factors.

In a present exemplary embodiment, however, the dummy pixels disposed in the display panel 110 may used to measure the temperature of the display panel 110. Since the kickback voltage VK is measured by the dummy pixels, the kickback voltage caused by temperature variations of the display panel 110 may be measured. Therefore, the temperature of the display panel 110 may be precisely calculated.

When the temperature of the display panel 110 differs from the reference temperature, the driving characteristics of semiconductor devices of the pixels, i.e., the thin film transistors, vary. Thus, the gamma voltages VGMA, which are set initially, no longer correspond to the variation in the driving characteristics of the thin film transistors, which is caused by the temperature variations of the display panel 110. In this case, the brightness may be non-uniform due to a difference in the current driving capabilities of the thin film transistors, which is caused by the temperature variations of the display panel 110, and as a result, the display quality of the display panel 110 may deteriorate.

However, in a present exemplary embodiment, the timing controller 120 compares the temperature of the display panel 110 measured using the kickback voltage VK with the reference temperature. When the temperature differs from the reference temperature, the timing controller 120 transmits a gamma voltage compensation signal VG_C to the gamma voltage generator 140 to compensate for the gamma voltages. The gamma voltage compensation signal VG_C may be determined by considering the variation in the display panel 110 temperature that corresponds to the difference between the measured temperature of the display panel 110 and the reference temperature.

The gamma voltage generator 140 compensates the gamma voltage VGMA in response to the gamma voltage compensation signal VG_C. The gamma voltage generator 140 transmits the compensated gamma voltage VGMA to the data driver 150. The data driver 150 generates the data voltages using the compensated gamma voltage VGMA and transmits the data voltages to the pixels and the dummy pixels. Accordingly, variations in the driving characteristics of the thin film transistors that are caused by temperature variations of the display panel 110 are compensated, which may improve the display quality of the display panel 110.

When the temperature of the display panel 110 differs from the reference temperature, the brightness of the display panel may vary depending on the temperature variation. For example, when the temperature of the display panel 110 increases, the brightness may decrease and the display quality may deteriorate.

When the measured temperature of the display panel 110 differs from the reference temperature, the timing controller 120 may change the data values of the image signals R', G', and B' by taking into consideration the temperature variation of the display panel 110. The timing controller 120 transmits the changed image signals R', G', and B' to the data driver 150.

The data driver 150 transmits data voltages corresponding to the changed image signals R', G', and B' to the pixels and the dummy pixels. Accordingly, brightness variations caused by temperature variations of the display panel 110 may be compensated, which may improve the display quality of the display panel 110.

Hereinafter, the kickback voltage corresponding to the reference temperature may be referred to as a reference kickback voltage. When the temperature of the display panel 110 changes, the kickback voltages of the thin film transistors of the pixels change. In general, the common voltage VCOM is determined by considering the reference kickback voltage. When the temperature of the display panel 110 differs from the reference temperature, the kickback voltage of the pixels may differ from the reference kickback voltage. The variation of the kickback voltage may cause a flicker, which may deteriorate the display quality of the display panel 110.

When the measured temperature of the display panel 110 differs from the reference temperature, the timing controller 120 transmits a common voltage compensation signal VC_C to the common voltage supply 160 to compensate the common voltage VCOM. The common voltage compensation signal VC_C may be determined by considering the temperature variation of the display panel 110.

The common voltage supply 160 compensates the level of the common voltage VCOM in response to the common voltage compensation signal VC_C. The common voltage supply 160 transmits the compensated common voltage VCOM to the display panel 110. Therefore, the variation of the kickback voltage caused by the temperature variation of the display panel 110 may be compensated, which may improve the display quality.

Consequently, the display apparatus 100 according to an exemplary embodiment compensates for the variation in display quality, which is caused by the temperature variation of the display panel 110, and improves the display quality.

Figure 3:
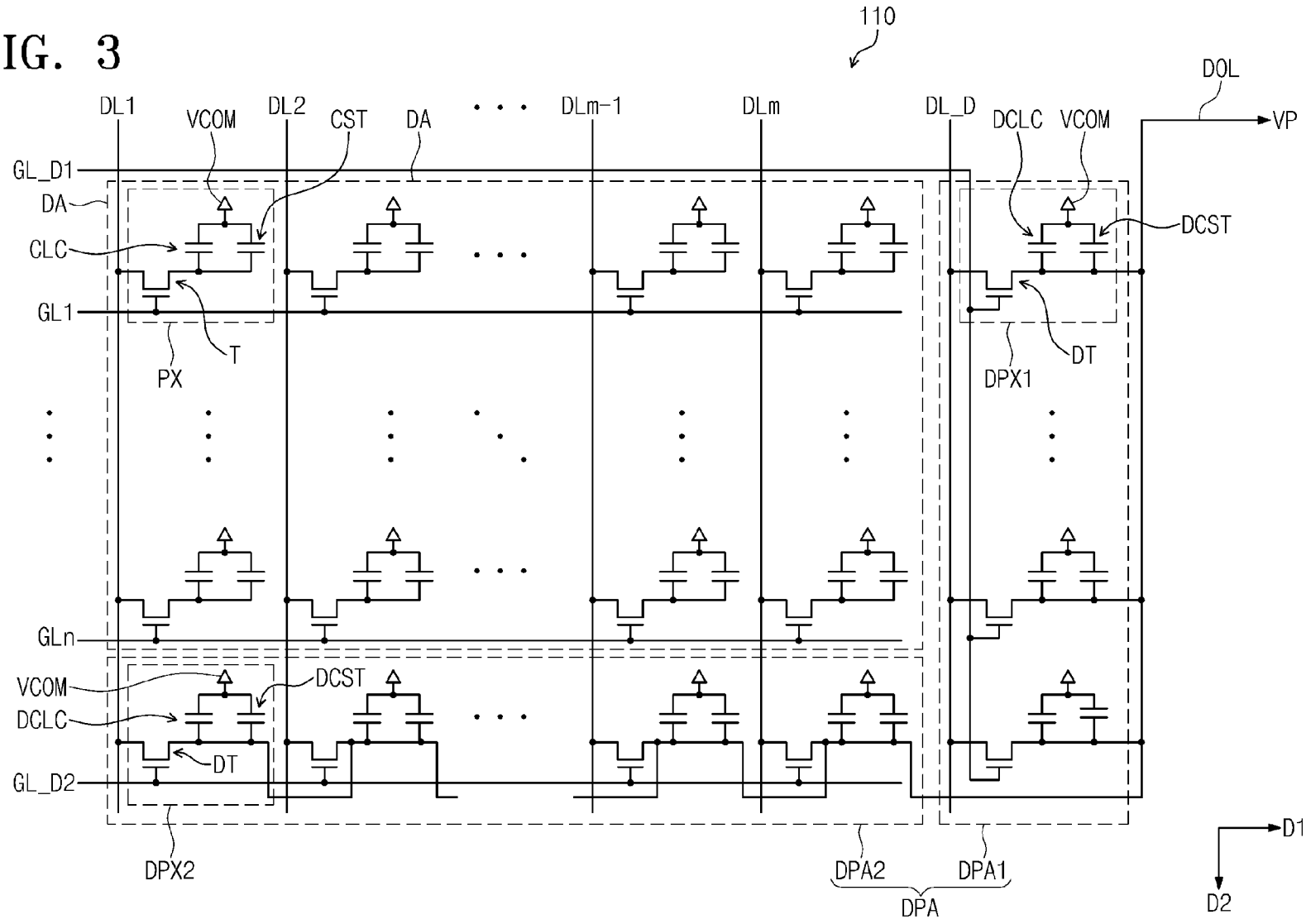
FIG. 3 is a circuit diagram of a configuration of a display panel shown in FIG. 1.
Figure 4:
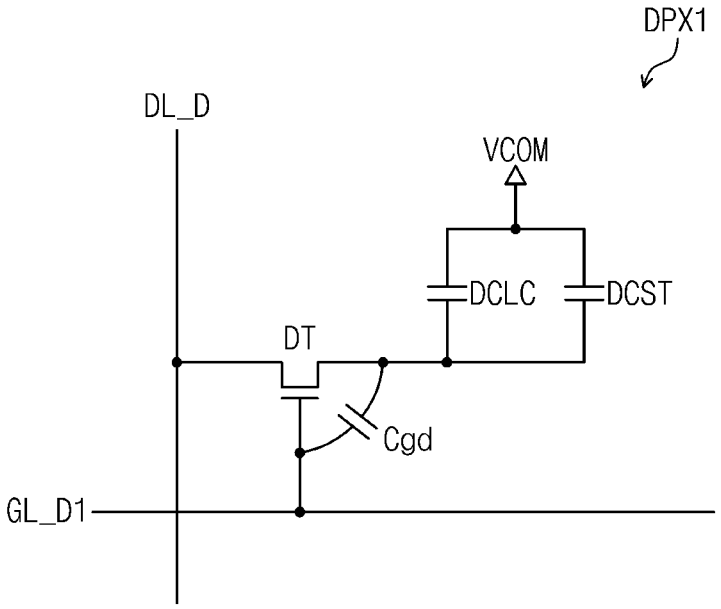
FIG. 4 is a circuit diagram of a first dummy pixel shown in FIG. 1.
Figure 5:
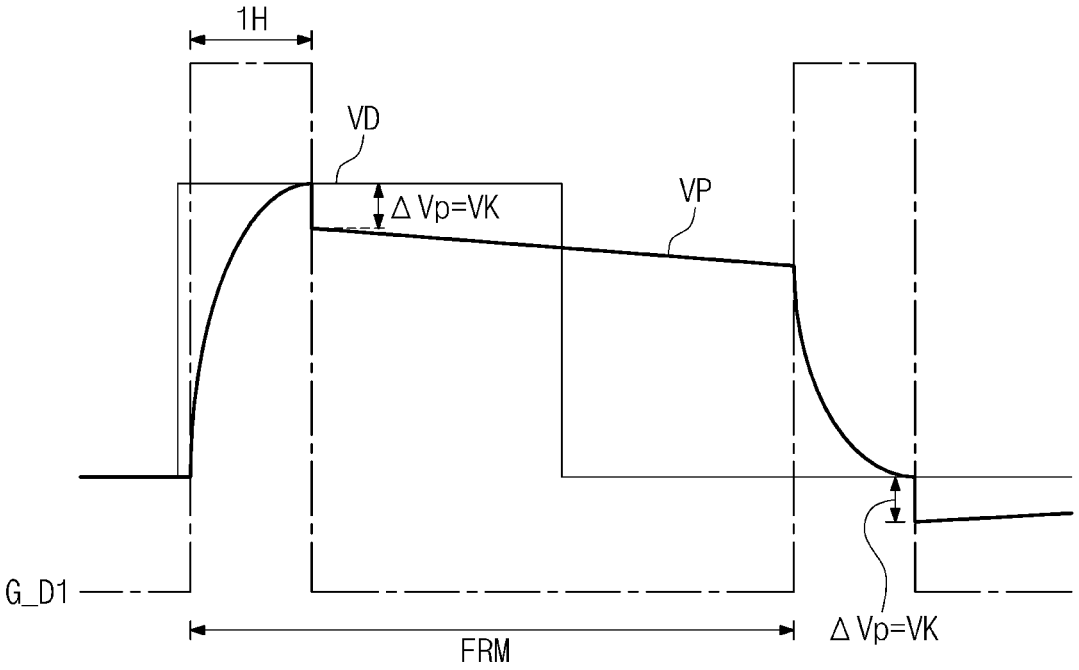
FIG. 5 is a timing diagram of charging the first dummy pixel.

FIG. 3 is a circuit diagram of a configuration of the display panel 110 shown in FIG. 1, FIG. 4 is a circuit diagram of a first dummy pixel shown in FIG. 1, and FIG. 5 is a timing diagram of charging the first dummy pixel.

Referring to FIGS. 3 and 4, the pixels PX are arranged in the display area DA as a matrix. The first gate lines GL1 to GLn are insulated from the first data lines DL1 to DLm while crossing the first data lines DL1 to DLm. Each the pixel PX is connected to a corresponding first gate line and a corresponding first data line.

Each pixel PX includes a transistor T, a liquid crystal capacitor CLC, and a storage capacitor CST. Each transistor T is connected to a corresponding first gate line and a corresponding first data line.

Each transistor T includes a gate electrode connected to the corresponding first gate line, a source electrode connected to the corresponding first data line, and a drain electrode connected to a corresponding liquid crystal capacitor CLC and a corresponding storage capacitor CST.

The transistors T turn on in response to the gate signals received through the first gate lines GL1 to GLn. The data voltages received through the first data lines DL1 to DLm are applied to the liquid crystal capacitors CLC through the turned-on transistors T.

The liquid crystal capacitors CLC are charged with the pixel voltages corresponding to the data voltages. In detail, each liquid crystal capacitor CLC is charged with a voltage difference between the data voltage and the common voltage VCOM. The image is displayed by the pixel voltages charged in the pixels PX.

The storage capacitors CST have a charge capacity smaller than that of the liquid crystal capacitor CLC and supplement the voltage charged in the liquid crystal capacitors CLC.

The dummy pixel area DPA includes a first dummy pixel area DPA1 and a second dummy pixel area DPA2. The first dummy pixel area DPA1 may be disposed adjacent to a first side of the display area DA and may extend in the second direction D2. The first dummy pixel area DPA1 extends to an edge portion of the display panel 110. According to embodiments, the first side may be a right side, and the edge portion may be a lower portion, but embodiments are not limited thereto.

The second dummy pixel area DPA2 may be disposed adjacent to second side of the display area DA that is perpendicular to the first side and may extend in the first direction D1. According to embodiments, the second side may be a lower side, but embodiments are not limited thereto. In addition, the second dummy pixel area DPA2 may be adjacent to a side of the lower portion of the first dummy pixel area DPA1.

The dummy pixels DPX1 and DPX2 respectively include a plurality of first dummy pixels DPX1 and a plurality of second dummy pixels DPX2. The first dummy pixels DPX1 may be arranged in one first line. The second dummy pixels DPX2 may be arranged in one second line perpendicular to the first line. According to embodiments, the first line may be a row, and the second line may be a column, but embodiments are not limited thereto.

However, the first dummy pixels DPX1 may be arranged in a plurality of columns in the first dummy pixel area DPA1, and the second dummy pixels DPX2 may be arranged in a plurality of rows in the second dummy pixel area DPA2.

The dummy gate lines GL_D1 and GL_D2 include a first dummy gate line GL_D1 and a second dummy gate line GL_D2, which are arranged such that the first gate lines GL1 to GLn are disposed between the first and second dummy gate lines GL_D1 and GL_D2.

The first dummy gate line GL_D1 may be disposed at an upper portion of a first gate line GL1. The first dummy gate line GL_D1 may extend to the first dummy pixel area DPA1 in the first direction D1, and then may extend in the first dummy pixel area DPA1 in the second direction D2. The second dummy gate line GL_D2 may be disposed at a lower portion of a last gate line GLn and may extend in the first direction D1.

The dummy data line DL_D may be disposed at a right side of a last data line DLm.

The first dummy pixels DPX1 may be connected to the first dummy gate line GL_D1 and the dummy data line DL_D. The second dummy pixels DPX2 may be connected to the second dummy gate line GL_D2 and corresponding first data lines DL1 to DLm.

The first dummy pixels DPX1 have a same configuration and size as those of the second dummy pixels DPX2. Each of the first and second dummy pixels DPX1 and DPX2 includes a dummy transistor DT, a dummy liquid crystal capacitor DCLC connected to the dummy transistor DT, and a dummy storage capacitor DCST connected to the dummy transistor DT.

The dummy transistor DT of each first dummy pixel DPX1 is connected to the first dummy gate line GL_D1 and the dummy data line DL_D. The dummy transistor DT of each second dummy pixel DPX2 is connected to the second dummy gate line GL_D2 and a corresponding first data line of the first data lines DL1 to DLm.

Each of the dummy transistors DT includes a dummy gate electrode connected to a corresponding dummy gate line of the first and second gate lines GL_D1 and GL_D2, a dummy source electrode connected to the corresponding data line of the data lines DL1 to DLm and DL_D, and a dummy drain electrode connected to the corresponding liquid dummy crystal capacitor DCLC and the corresponding dummy storage capacitor DCST.

The dummy drain electrodes of the dummy transistors DT of the first dummy pixels DPX1, which are connected to each other, are connected to a dummy output line DOL. The dummy drain electrodes of the dummy transistors DT of the second dummy pixels DPX2, which are connected to each other, are connected to the dummy output line DOL. The dummy output line DOL is connected to the kickback voltage detector 170.

The first and second dummy pixels DPX1 and DPX2 have substantially the same configuration and size as those of the pixels PX.

The dummy transistors DT of the first and second dummy pixels DPX1 and DPX2 turn on in response to gate signals with the same timing received through the first and second dummy gate lines GL_D1 and GL_D2.

The turned-on dummy transistors DT receive the data voltages through the first data lines DL1 to DLm and the dummy data line DL_D and transmit the data voltages to the dummy liquid crystal capacitors DCLC, respectively. The dummy liquid crystal capacitors DCLC are charged with the dummy pixel voltages corresponding to the data voltages. Each dummy storage capacitor DCST supplements the voltage charged in the corresponding dummy liquid crystal capacitor DCLC.

The dummy liquid crystal capacitors DCLC of the first and second dummy pixels DPX1 and DPX2 may be commonly connected to the dummy output line DOL, and thus the dummy liquid crystal capacitors DCLC may share electric charges. Accordingly, a dummy pixel voltage VP of the first and second dummy pixels DPX1 and DPX2 is transmitted to the kickback voltage detector 170 through the dummy output line DOL.

As shown in FIG. 4, a parasitic capacitor Cgd may be formed between the gate electrode and the drain electrode of the dummy transistor DT of the first dummy pixel DPX1. In addition, a parasitic capacitor may be formed between the gate electrode and the source electrode of the dummy transistor DT. The kickback voltage may be generated by the parasitic capacitor Cgd of the dummy transistor DT.

Since the first and second dummy pixels DPX1 and DPX2 have the same configuration and size, a parasitic capacitor may also be formed in each of the second dummy pixels DPX2. Therefore, a kickback voltage may be generated in the second dummy pixels DPX2. The kickback voltage detector 170 can detect the kickback voltage from the dummy pixel voltage VP received through the dummy output line DOL.

For example, the dummy pixel voltage VP charged in the dummy pixels DPX1 and DPX2 may increase to the level of the data voltage VD, i.e., a high level, during an activation period (1H) of the gate signal G_D1 in one frame FRM. However, when the gate signal transitions to a non-activation level, i.e., a low level, from the high level, a kickback voltage is generated by the parasitic capacitor Cgd. In this case, the dummy pixel voltage VP decreases by the level of the kickback voltage VK.

The kickback voltage detector 170 detects the kickback voltage VK of the dummy pixel voltage VP when the gate signal transitions to a low level from the high level. As described above, the temperature of the display panel 110 may be calculated using the kickback voltage VK, and thus the display quality variation caused by the temperature variation may be compensated. A method of calculating the temperature of the display panel 110 using the kickback voltage VK may be as described above.

Figure 6:
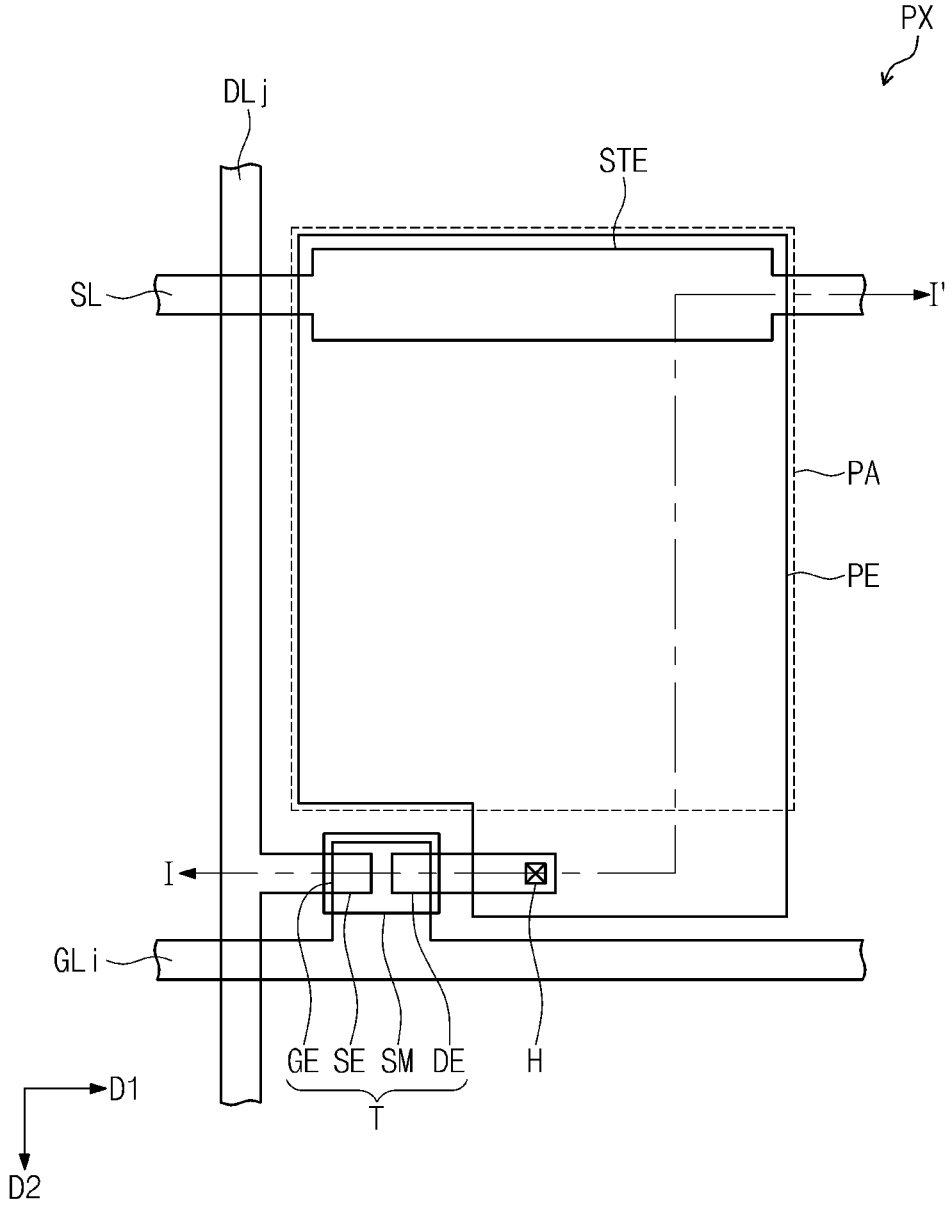
FIG. 6 is a layout diagram of a pixel shown in FIG. 3.

FIG. 6 is a layout diagram of the pixel shown in FIG. 3.

For convenience of explanation, only one pixel PX is shown in FIG. 6, but other pixels PX have the same structure as that of the one pixel PX.

Referring to FIG. 6, a pixel PX includes a transistor T connected to the corresponding gate line GLi and the corresponding data line DLj, and a pixel electrode PE connected to the transistor T. In a present exemplary embodiment, "i" is an integer greater than zero and less than or equal to "n", and "j" is an integer greater than zero and less than or equal to"m".

The pixel PX includes a pixel area PA and a non-pixel area NPA adjacent to the pixel area PA when viewed in a plan view. The pixel electrode PE is disposed in the pixel area PA and the transistor T is disposed in the non-pixel area NPA.

The transistor T includes a gate electrode GE that branches from the gate line GLi, a source electrode SE that branches from the data line DLj, a drain electrode DE connected to the pixel electrode PE, and a semiconductor layer SM that forms a conductive channel between the source electrode SE and the drain electrode DE. The drain electrode DE is electrically connected to the pixel electrode PE through a contact hole H.

The pixel electrode PE extends into the non-pixel area NPA, in which the drain electrode DE is disposed, and is connected to the drain electrode DE through the contact hole H.

The pixel PX includes a storage electrode STE. The storage electrode STE branches in the second direction D2 from a storage line SL that extends in the first direction D1, and overlaps a predetermined portion of the pixel electrode PE. The storage electrode STE is disposed on the same layer as the gate electrode GE.

Figure 7:
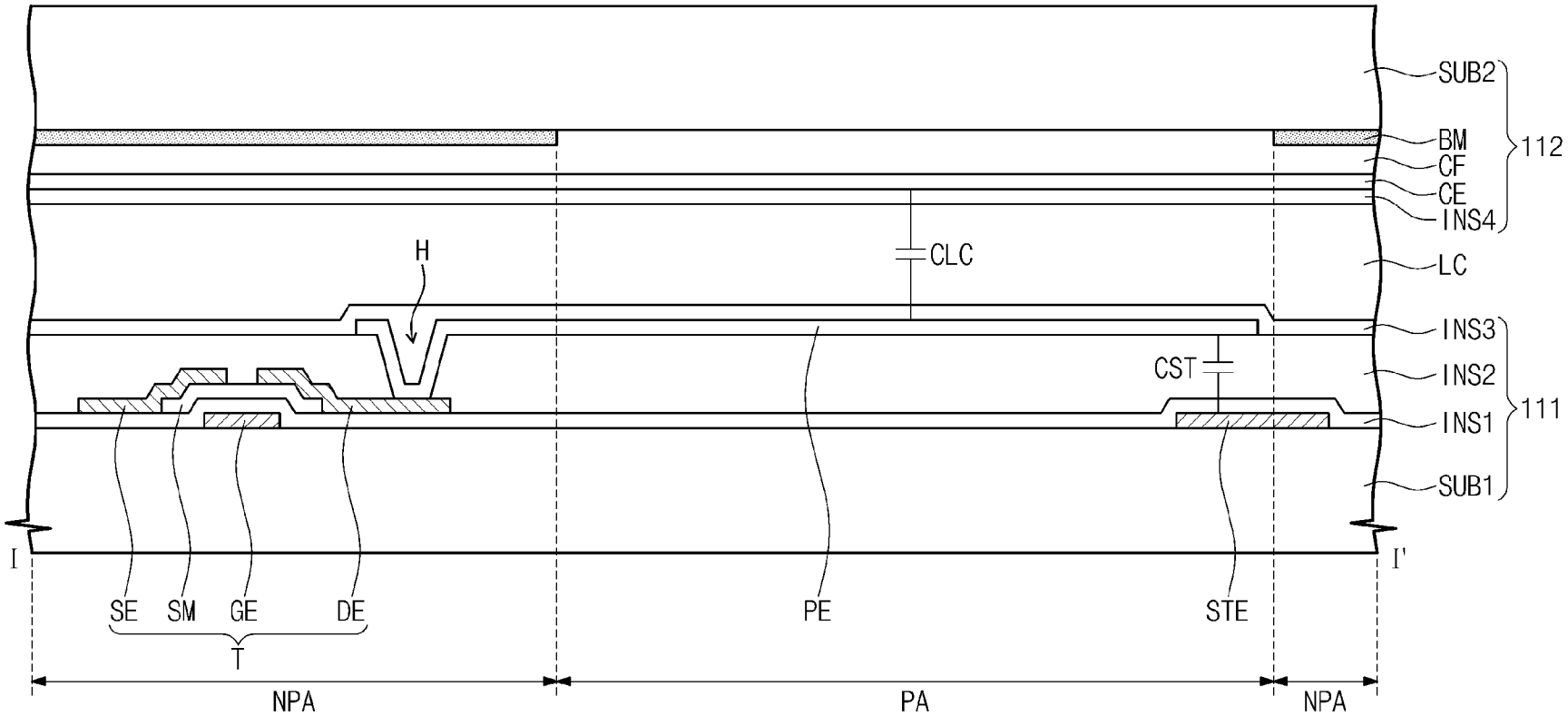
FIG. 7 is a cross-sectional view taken along a line I-I' shown in FIG. 6.

FIG. 7 is a cross-sectional view taken along a line I-I' shown in FIG. 6. Referring to FIG. 7, the display panel 110 includes a first substrate 111, a second substrate 112, and a liquid crystal layer LC disposed between the first substrate 111 and the second substrate 112.

The first substrate 111 includes a first base substrate SUB1, the transistor T, the pixel electrode PE, and the storage electrode STE.

The gate electrode GE of the transistor T is disposed on the first base substrate SUB1. A first insulating layer INS1 is disposed on the first base substrate SUB1 to cover the gate electrode GE and the storage electrode STE. The first insulating layer INS1 may serve as a gate insulating layer.

The semiconductor layer SM of the transistor T is disposed on the first insulating layer INS1, and may include an active layer and an ohmic contact layer. The source electrode SE and the drain electrode DE of the transistor T are disposed on the semiconductor layer SM and the first insulating layer INS1 and are spaced apart from each other. The semiconductor layer SM forms the conductive channel between the source electrode SE and the drain electrode DE.

A second insulating layer INS2 is disposed on the first insulating layer INS1 to cover the transistor T. A passivation layer may be disposed between the first and second insulating layers INS1 and INS2 to cover the transistor T. The passivation layer may cover the exposed upper portion of the semiconductor layer SM.

The contact hole H penetrates through the second insulating layer INS2 to expose a predetermined area of the drain electrode DE. The drain electrode DE is electrically connected to the pixel electrode PE through the contact hole H.

The pixel electrode PE may be formed of a transparent conductive material, such as indium tin oxide (ITO), indium zinc oxide (IZO), indium tin zinc oxide (ITZO), etc. A third insulating layer INS3 is disposed on the second insulating layer INS2 to cover the pixel electrode PE.

The second substrate 112 includes a second base substrate SUB2, a black matrix BM, a color filter CF, and a common electrode CE. The second base substrate SUB2 may be disposed to face the first base substrate SUB1.

The black matrix BM is disposed on a lower surface of the second base substrate SUB2 in the non-pixel area NPA. The color filter CF is disposed under the second base substrate SUB2 to correspond to the pixel PX. The color filter CF may cover the black matrix BM. The color filter CF imparts a color to light passing through the pixel PX. The color filter CF may be one of a red filter, a green filter, and a blue filter.

The black matrix BM blocks a portion of light that is not needed for image display. The black matrix BM may prevent light leakage caused by malfunction of the liquid crystal molecules at the edges of the pixel are PA or by color mixture occurring at the edges of the color filters CF.

The common electrode CE is disposed under the color filter CF. The common electrode CE may be formed of a transparent conductive material, such as indium tin oxide, indium zinc oxide, indium tin zinc oxide, etc. A fourth insulating layer INS4 is disposed under the common electrode CE.

The pixel electrode PE, the common electrode CE, and the liquid crystal layer LC disposed between the pixel electrode PE and the common electrode CE form the liquid crystal capacitor CLC. The pixel electrode PE receives a data voltage through the turned-on transistor T and the common electrode CE receives the common voltage VCOM.

Due to the voltage level difference between the data voltage and the common voltage VCOM, an electric field is formed between the pixel electrode PE and the common electrode CE. The liquid crystal molecules of the liquid crystal layer LC are realigned by the electric field and control a transmittance of light propagating through the pixel PX, thereby displaying a desired image.

The pixel electrode PE, the storage electrode STE, and the first and second insulating layers INS1 and INS2 disposed between the pixel electrode PE and the storage electrode STE form the storage capacitor CST. The storage electrode STE receives the common voltage VCOM through the storage line SL.

Figure 8:
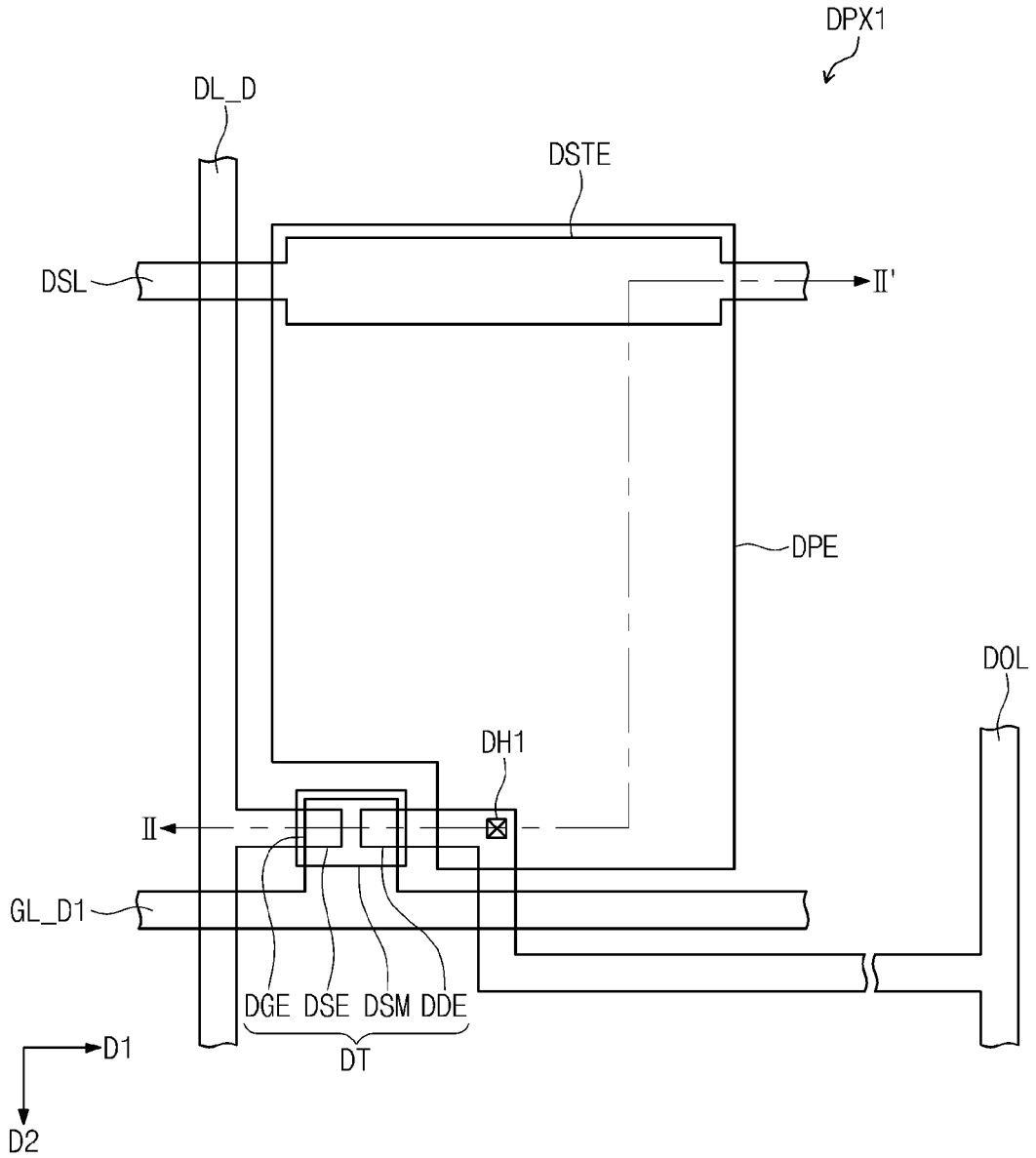
FIG. 8 is a layout diagram of the first dummy pixel shown in FIG. 3.
Figure 9:
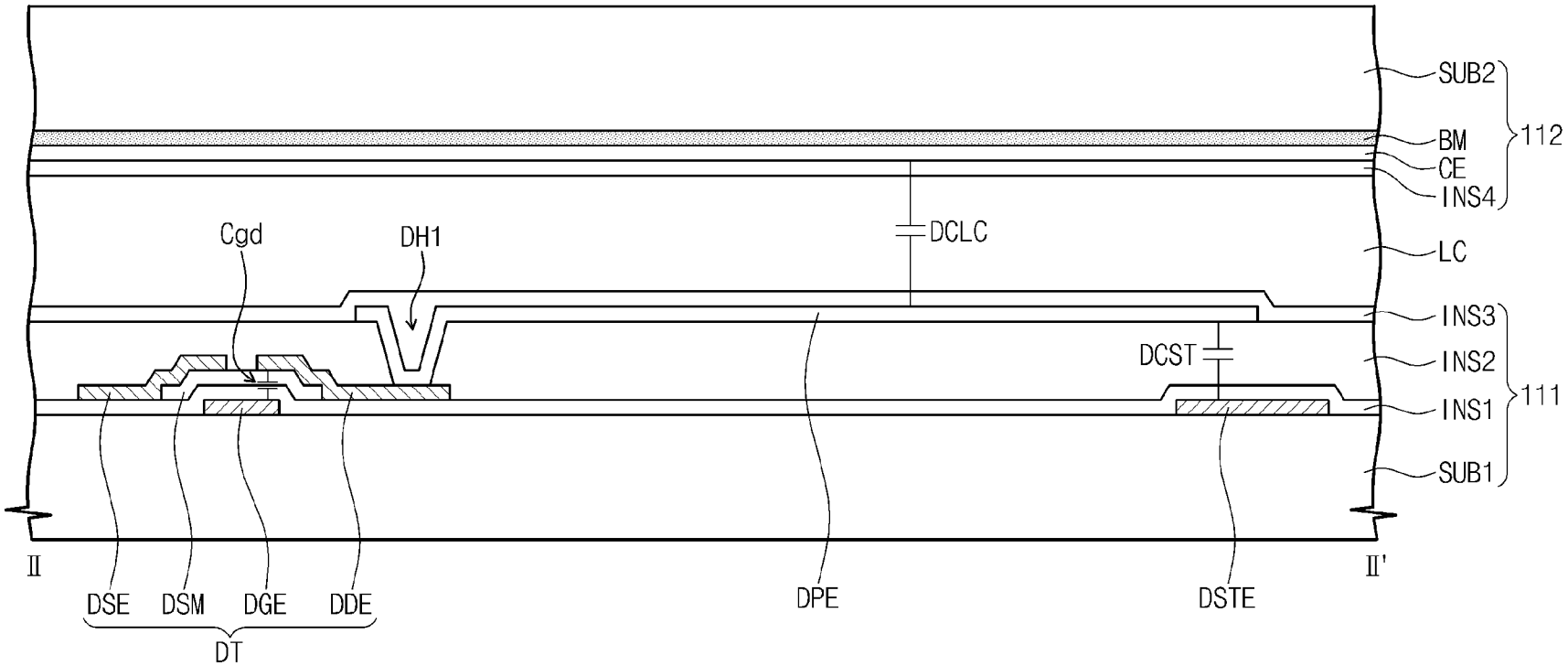
FIG. 9 is a cross-sectional view taken along a line II-IP shown in FIG. 8.

FIG. 8 is a layout diagram of the first dummy pixel shown in FIG. 3 and FIG. 9 is a cross-sectional view taken along a line IMP shown in FIG. 8.

Referring to FIGS. 8 and 9, the first dummy pixel DPX1 includes a dummy transistor DT, a dummy pixel electrode DPE, and a dummy storage electrode DSTE that branches from a dummy storage line DSL. The transistor DT includes a dummy gate electrode DGE, a dummy source electrode DSE, a dummy drain electrode DDE, and a dummy semiconductor layer DSM.

The dummy drain electrode DDE is connected to the dummy pixel electrode DPE through a first dummy contact hole DH1. In addition, the dummy drain electrode DDE is connected to the dummy output line DOL.

No color filter CF is disposed on the second substrate 112. The black matrix BM is disposed on the lower surface of the entire second base substrate SUB2 of the second substrate 112 to block light. Accordingly, the first dummy pixel DPX1 does not display an image.

The kickback voltage is generated in the first dummy pixel DPX1 due to a parasitic capacitor Cgd formed between the dummy gate electrode DGE and the dummy drain electrode DDE (or the dummy source electrode DSE).

The first dummy pixel DPX1 has substantially the same structure as that of the pixel PX except that the dummy drain electrode DDE is connected to the dummy output line DOL and no color filter CF is disposed on the second substrate 112. Therefore, further details of the first dummy pixel DPX1 will be omitted to avoid redundancy.

Figure 10:
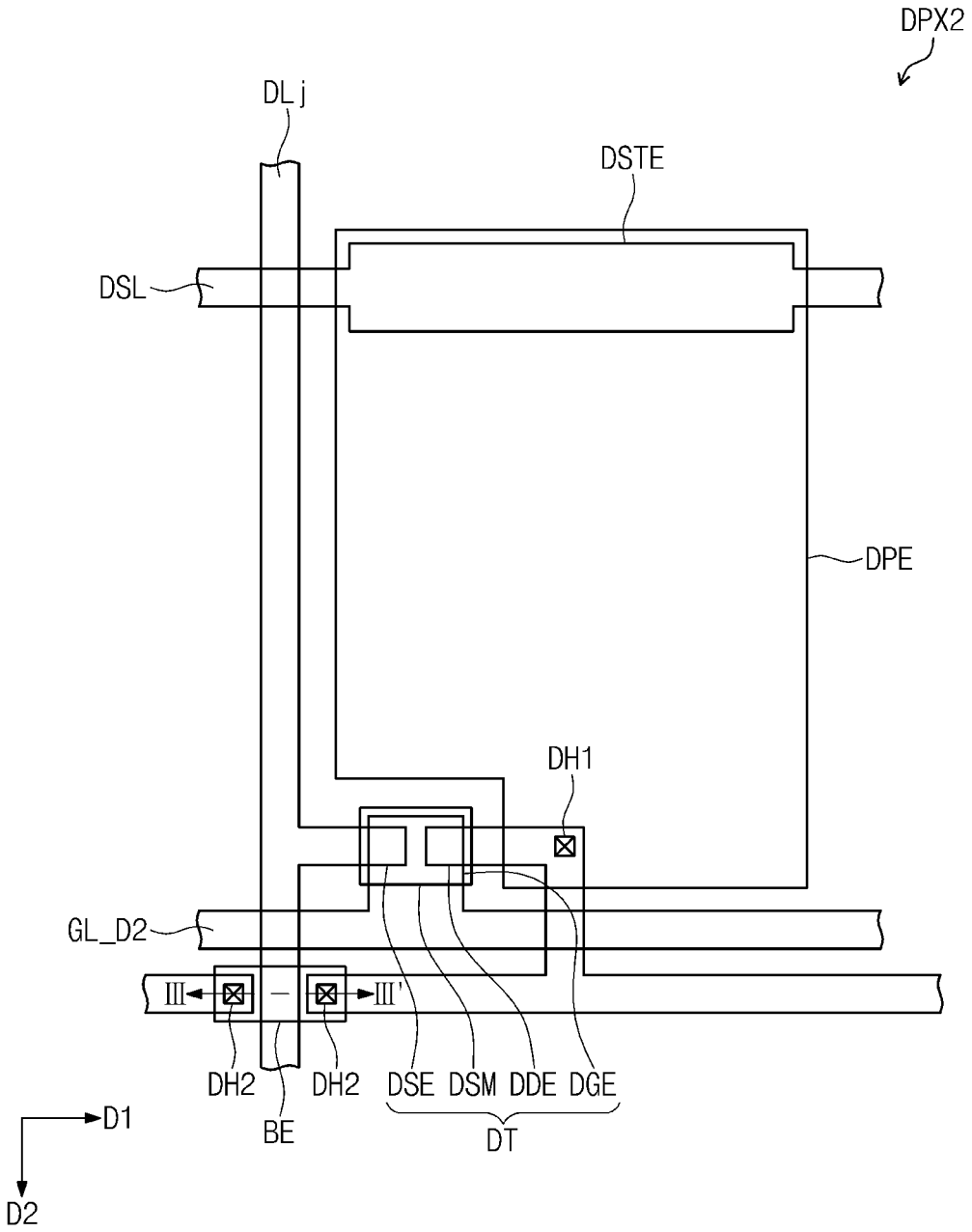
FIG. 10 is a layout diagram of a second dummy pixel shown in FIG. 3.
Figure 11:
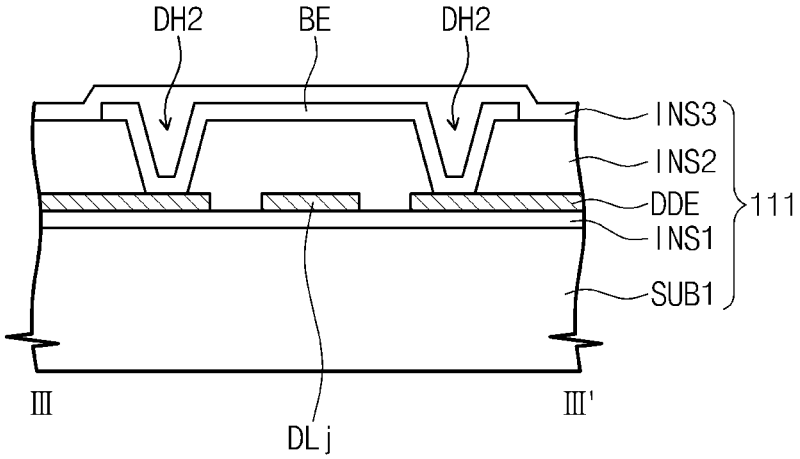
FIG. 11 is a cross-sectional view taken along a line shown in FIG. 10.

FIG. 10 is a layout diagram of the second dummy pixel shown in FIG. 3 and FIG. 11 is a cross-sectional view taken along a line shown in FIG. 10. For the convenience of explanation, FIG. 11 shows only the first substrate 111.

Referring to FIGS. 10 and 11, the dummy drain electrode DDE of the dummy transistor DT of the second dummy pixel DPX2 is connected to an adjacent dummy drain electrode DDE of the dummy transistor DT.

In detail, the dummy drain electrode DDE extends in the second direction D2 from the first dummy contact hole DH1 past the second dummy gate line GL_D2 and then extends discontinuously in the first direction D1. The dummy drain electrode DDE is disposed on the same layer as the data line DL_j, which is interposed between disjoint branches of the dummy drain electrode DDE extending in the first direction D1 that are connected to each other through a bridge electrode BE.

The bridge electrode BE is disposed on the second insulating layer INS2. The bridge electrode BE is connected to the adjacent dummy drain electrodes DDE through second dummy contact holes DH2 that penetrate through the second insulating layer INS2. In addition, a dummy drain electrode DDE disposed at a rightmost position of the second dummy pixels DPX2 may be connected to the dummy output line DOL, similar to the first dummy pixel DPX1 shown in FIG. 8.

Other configurations of the second dummy pixel DPX2 are substantially the same as those of the first dummy pixel DPX1, and thus further details of the second dummy pixel DPX2 will be omitted to avoid redundancy.

The kickback voltage is generated in the first dummy pixel DPX1 due to the parasitic capacitor Cgd formed between the dummy gate electrode DGE and the dummy drain electrode DDE (or the dummy source electrode DSE).

As described above, variations in the display quality caused by temperature variations of the display panel 110 may be compensated by using the kickback voltage VK of the dummy pixel voltage VP of the first and second dummy pixels DPX1 and DPX2.

Consequently, the display apparatus 100 according to an exemplary embodiment may compensate for display quality variations caused by temperature variations, which may improve the display quality of the display apparatus 100.

Figure 12:
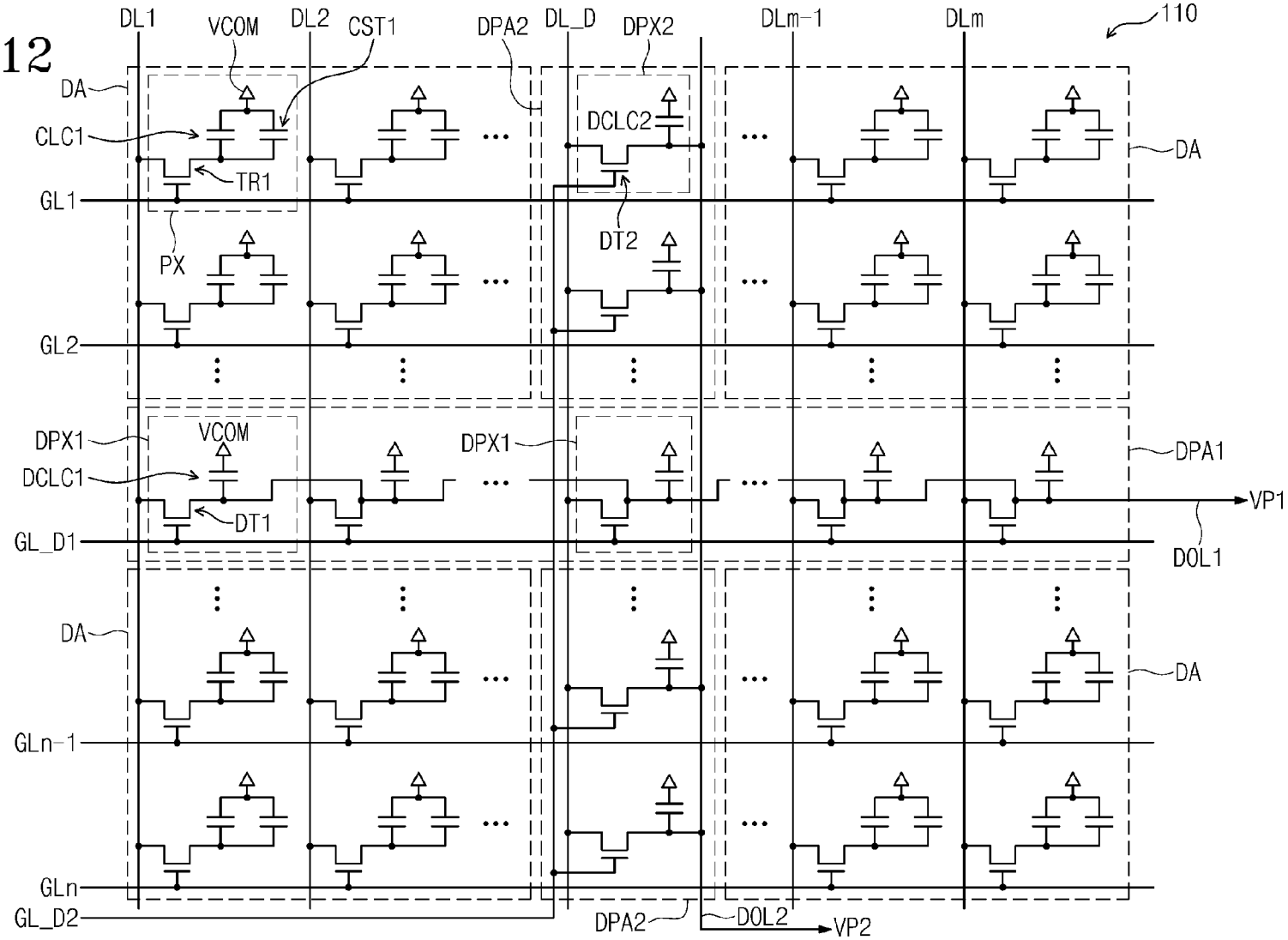
FIG. 12 is a circuit diagram of a configuration of a display panel according to another exemplary embodiment of the present disclosure.

FIG. 12 is a circuit diagram of a configuration of a display panel according to another exemplary embodiment of the present disclosure.

A display apparatus according to another exemplary embodiment has substantially the same configuration as that of the display apparatus 110 according to the exemplary embodiment of FIGS. 3-11 except for the configuration of the display panel 110. Accordingly, hereinafter, only the configuration of the display panel 110 will be described with reference to FIG. 12.

Referring to FIG. 12, dummy pixels DPX1 and DPX2 are arranged in a cross shape and disposed between the pixels PX. In detail, dummy pixel areas DPA1 and DPA2 are disposed on the display panel 110 to have the cross shape. The display area DA is divided into four areas by the dummy pixel areas DPA1 and DPA2.

A plurality of pixels PX is arranged in the display area DA as a matrix. The pixels PX are connected to first gate lines GL1 to GLn and first data lines DL1 to DLm. The pixels PX have substantially the same structure and function as those of the pixels PX shown in FIG. 3, and thus further detailed descriptions of the pixels PX will be omitted.

The dummy pixel areas DPA1 and DPA2 include a first dummy pixel area DPA1 that extends in a first direction D1 and two second dummy pixel areas DPA2 that extend in a second direction D2. The first dummy pixel area DPA1 is disposed between the two second dummy pixel areas DPA2.

The dummy pixels DPX1 and DPX2 include a plurality of first dummy pixels DPX1 arranged in one row in the first dummy pixel area DPA1 and a plurality of second dummy pixels DPX2 arranged in one column in the second dummy pixel areas DPA2.

Dummy gate lines GL_D1 and GL_D2 include a first dummy gate line GL_D1 and a second dummy gate line GL_D2. The first dummy gate line GL_D1 is disposed at a center position of the first gate lines GL1 to GLn and extends in the D1 direction. The second dummy gate line GL_D2 is disposed on the periphery of the display area DA and extends in the first direction D1 to the second dummy pixel areas DPA2, then turns and in the second direction D2 in the second dummy pixel areas DPA2. The dummy data line DL_D is disposed at a center position of the first data lines DL1 to DLm and extends in the D2 direction.

The first dummy pixels DPX1 are connected to the first dummy gate line GL_D1, corresponding first data lines DL1 to DLm, and the corresponding dummy data line DL_D. In detail, the first dummy pixel DPX1 disposed between the second dummy pixel areas DPA2 is connected to the dummy data line DL_D. The second dummy pixels DPX2 are connected to the second dummy gate line GL_D2 and the dummy data line DL_D.

Each of the first dummy pixels DPX1 includes a first dummy transistor DT1 and a first dummy liquid crystal capacitor DCLC1 connected to the first dummy transistor DT1. Each of the first dummy transistors DT1 is connected to the first dummy gate line GL_D1 and a corresponding data line DL1 to DLm and DL_D.

Each of the first dummy transistors DT1 includes a first dummy gate electrode connected to the first dummy gate line GL_D1, a first dummy source electrode connected to the corresponding data line DL1 to DLm and DL_D, and a first dummy drain electrode connected to the corresponding first dummy liquid crystal capacitor DCLC1. The first dummy drain electrodes are connected to each other and connected to a first dummy output line DOLL Each of the second dummy pixels DPX2 includes a second dummy transistor DT2 and a second dummy liquid crystal capacitor DCLC2 connected to the second dummy transistor DT2. The second dummy transistor DT2 is connected to the second dummy gate line GL_D2 and the dummy data line DL_D.

The second dummy transistor DT2 includes a second dummy gate electrode connected to the second dummy gate line GL_D2, a second dummy source electrode connected to the dummy data line DL_D, and a second dummy drain electrode connected to a corresponding second dummy liquid crystal capacitor DCLC2. The second dummy drain electrodes are connected to each other and connected to a second dummy output line DOL2. The first and second dummy output lines DOL1 and DOL2 are connected to the kickback voltage detector 170.

The gate lines GL1 to GLn, GL_D1, and GL_D2 sequentially receive the gate signals row-by-row, from top to bottom. The first dummy transistors DT1 of the first dummy pixels DPX1 receive the data voltages through the first data lines DL1 to DLm and the dummy data line DL_D in response to the gate signal received through the first dummy gate line GL_D1. The data voltages are charged in the first dummy liquid crystal capacitors DCLC1.

A dummy pixel voltage VP1 of the first dummy pixels DPX1 is transmitted to the kickback voltage detector 170 through the first dummy output line DOL1. The kickback voltage detector 170 may detect a first kickback voltage from the first dummy pixel voltage VP1.

The second dummy transistors DT2 of the second dummy pixels DPX2 receive a data voltage through the dummy data line DL_D in response to the gate signal received through the second dummy gate line GL_D2. The data voltage is charged in the second dummy liquid crystal capacitors DCLC2.

A second dummy pixel voltage VP2 of the second dummy pixels DPX2 is transmitted to the kickback voltage detector 170 through the second dummy output line DOL2. The kickback voltage detector 170 may detect a second kickback voltage from the second dummy pixel voltage VP2.

The kickback voltage detector 170 outputs an average value of the first and second kickback voltages VP1, VP2 as the kickback voltage VK. As described above, display quality variations caused by temperature variations of the display panel 110, may be compensated since the temperature of the display panel 110 can be calculated using the kickback voltage VK.

Consequently, a display apparatus according to a present exemplary embodiment compensates for display quality variations caused by the temperature variations, which may improve the display quality of the display apparatus.

Figure 13:
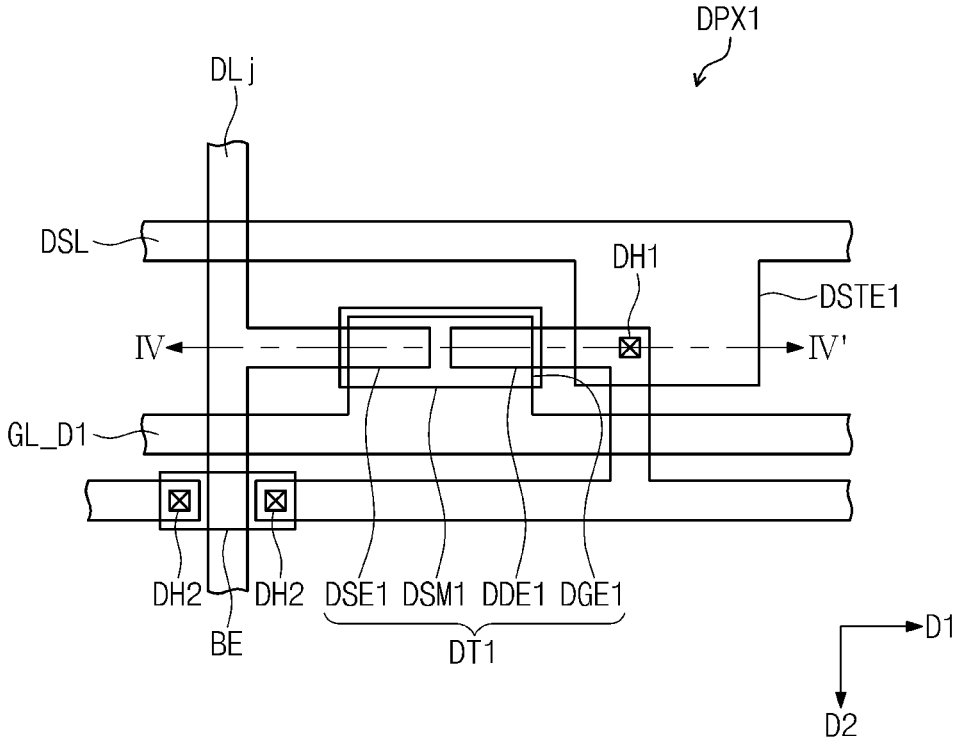
FIG. 13 is a layout diagram of a first dummy pixel shown in FIG. 12.
Figure 14:
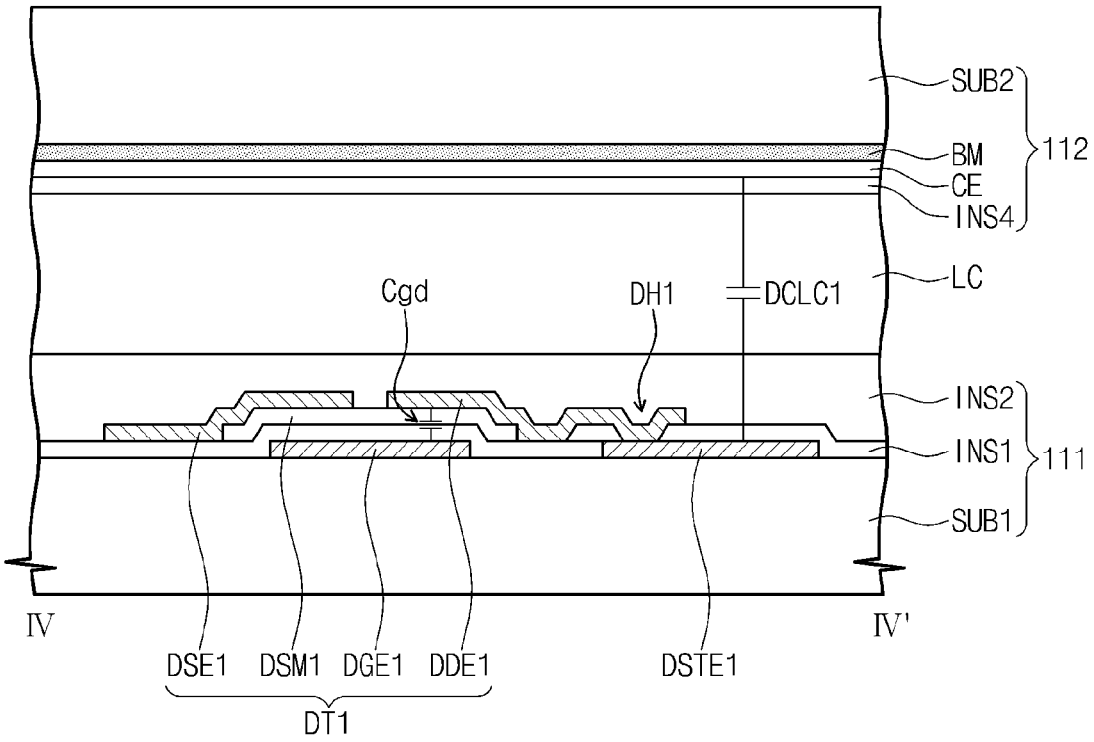
FIG. 14 is a cross-sectional view taken along a line IV-IV' shown in FIG. 13.

FIG. 13 is a layout diagram of the first dummy pixel shown in FIG. 12 and FIG. 14 is a cross-sectional view taken along a line IV-IV' shown in FIG. 13.

Referring to FIGS. 13 and 14, the first dummy pixel DPX1 includes the first dummy transistor DT1 and a first dummy storage electrode DSTE1 that branches from the dummy storage line DSL.

The first dummy transistor DT1 includes a first dummy gate electrode DGE1 that branches from the first dummy gate line GL_D1, a first dummy source electrode DSE1 that branches from the data line DLj, a first dummy drain electrode DDE1 connected to the first dummy storage electrode DSTE1, and a first dummy semiconductor layer DSM1 that forms a conductive channel between the first dummy source electrode DSE1 and the first dummy drain electrode DDE1.

The configurations of the first substrate 111 on which the first dummy pixel DPX1 is disposed and the second substrate 112 are substantially the same as those of the first substrate 111 on which the dummy pixel PDX is disposed and the second substrate 112 according to the exemplary embodiment of FIGS. 3-11, and thus further detailed descriptions of the first substrate 111 and the second substrate 112 will be omitted for.

A first dummy contact hole DH1 penetrates through the first insulating layer INS1 to expose a predetermined portion of the first dummy storage electrode DSTE1. The first dummy drain electrode DDE1 is electrically connected to the first dummy storage electrode DSTE1 through the first dummy contact hole DH1.

In a present exemplary embodiment, the dummy storage line DSL does not receive the common voltage. The first dummy storage electrode DSTE1 receives a corresponding data voltage through the turned-on first dummy transistor DT1.

The first dummy drain electrode DDE1 is electrically connected to the first dummy drain electrode DDE1 of an adjacent first dummy pixel DPX1 through the bridge electrode BE, and the data line DLj is disposed between the two adjacent first dummy drain electrodes DDE1. The structure of adjacent first dummy drain electrodes DDE1 being electrically connected through the bridge electrode BE is substantially the same as the structure shown in FIG. 11 of adjacent dummy drain electrodes DDE being connected through the bridge electrode BE.

In addition, a first dummy drain electrode DDE1 disposed at a rightmost position of the first dummy pixels DPX1 may be connected to the first dummy output line DOL1.

The first dummy storage electrode DSTE1, the common electrode CE, and the liquid crystal layer LC disposed between the first dummy storage electrode DSTE1 and the common electrode CE form the first dummy liquid crystal capacitor DCLC1. The first dummy liquid crystal capacitor DCLC1 has a capacitance less than that of the dummy liquid crystal capacitor DCLC according to the exemplary embodiment of FIGS. 3-11.

Since the dummy liquid crystal capacitor DCLC is substantially the same as the liquid crystal capacitor CLC of the pixel PX, the capacitance of the first dummy liquid crystal capacitor DCLC1 is less than that of the liquid crystal capacitor CLC of the pixel PX.

An area where the first dummy gate electrode DGE1 overlaps the first dummy source and drain electrodes DSE1 and DDE1 is greater than an area in which the gate electrode of the pixel PX overlaps the source and drain electrodes.

Accordingly, a parasitic capacitor Cgd formed between the first dummy gate electrode DGE1 and the first dummy drain electrode DDE1 (or the first dummy source electrode DSE1) of the first dummy pixel DPX1 has a capacitance greater than that of a parasitic capacitor formed between the gate electrode and the drain electrode (or the source electrode) of the pixel PX. In this case, the first kickback voltage is greater than the kickback voltage of the pixel PX.

The pixel PX has a same size as the first and second dummy pixels DPX1 and DPX2 according to the exemplary embodiment of FIGS. 3-11. Therefore, the first kickback voltage is greater than the kickback voltage of each of the first and second dummy pixels DPX1 and PDX2 according to the exemplary embodiment of FIGS. 3-11.

Figure 15:
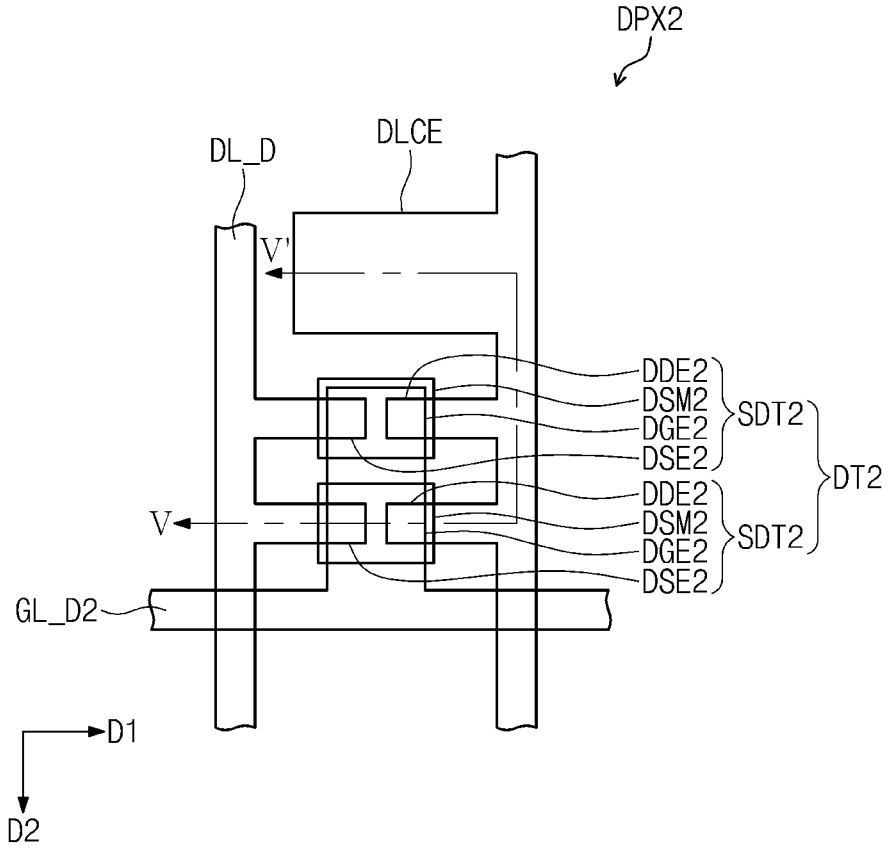
FIG. 15 is a layout diagram of a second dummy pixel shown in FIG. 12.
Figure 16:
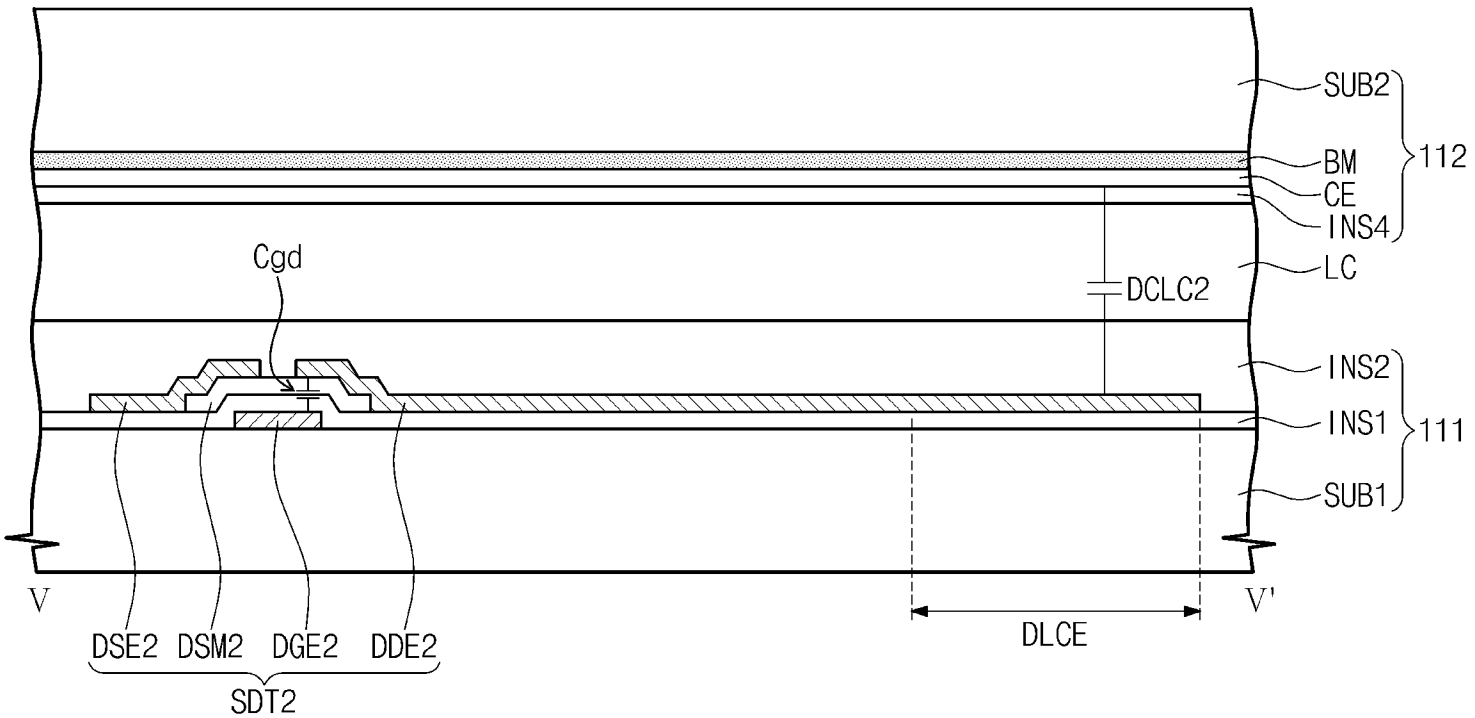
FIG. 16 is a cross-sectional view taken along a line V-V' shown in FIG. 15.

FIG. 15 is a layout diagram of the second dummy pixel shown in FIG. 12 and FIG. 16 is a cross-sectional view taken along a line V-V' shown in FIG. 15.

Referring to FIGS. 15 and 16, the second dummy pixel DPX2 includes a second dummy transistor DT2 and a dummy liquid crystal electrode DLCE connected to the second dummy transistor DT2. The dummy liquid crystal electrode DLCE may have a same size as that of the first dummy storage electrode DSTE1 when viewed in a plan view.

The second dummy transistor DT2 includes a plurality of second sub-dummy transistors SDT2. As an example, two second sub-dummy transistors SDT2 are shown in FIG. 15, but the number of the second sub-dummy transistors SDT2 of the second dummy transistor DT2 is not limited to two.

Second dummy gate electrodes DGE2 of the second sub-dummy transistors SDT2 branch from the second dummy gate line GL_D2. Second dummy source electrodes DSE2 of the second sub-dummy transistors SDT2 branch from the dummy data line DL_D.

Second dummy drain electrodes DDE2 of the second sub-dummy transistors SDT2 are connected to each other. The dummy liquid crystal electrode DLCE branches from the second dummy drain electrodes DDE2.

The second dummy drain electrodes DDE2 of adjacent second sub-dummy transistors SDT2 are connected to each other.

Each of the second sub-dummy transistors SDT2 includes a second dummy semiconductor layer DSM2 that forms a conductive channel between the second dummy source electrode DSE2 and the second dummy drain electrode DDE2.

The configurations of the first substrate 111 on which the second sub-dummy transistors SDT2 are disposed and the second substrate 112 are substantially the same as those of the first substrate 111 and the second substrate 112 according to the exemplary embodiment of FIGS. 3-11, and thus further detailed descriptions of the first substrate 111 and the second substrate 112 will be omitted.

The dummy liquid crystal electrode DLCE, the common electrode CE, and the liquid crystal layer LC disposed between the dummy liquid crystal electrode DLCE and the common electrode CE form the second dummy liquid crystal capacitor DCLC2. The second dummy liquid crystal capacitor DCLC2 has a capacitance less than that of the liquid crystal capacitor CLC of the pixel PX.

An area where the second dummy gate electrodes DGE2 overlap the second dummy source and drain electrodes DSE2 and DDE2 of the second sub-dummy transistors SDT2 is greater than an area in which the gate electrode overlaps the source and drain electrodes of the pixel PX.

Thus, since the second dummy transistor DT2 includes a plurality of second sub-dummy transistors SDT2, a capacitance of the parasitic capacitor Cgd of the second dummy pixel DPX2 is greater than a capacitance of the parasitic capacitor of the pixel PX. Accordingly, the second kickback voltage is greater than the kickback voltage of each of the first and second dummy pixels DPX1 and DPX2 according to the exemplary embodiment of FIGS. 3-11.

In a present exemplary embodiment, the kickback voltage VK can be varied to be greater than the kickback voltage VK according to the exemplary embodiment of FIGS. 3-11, but the inherent dielectric constant of the liquid crystal layer does not vary in a present exemplary embodiment. Since the inherent dielectric constant of the liquid crystal layer does not vary, the temperature corresponding to the kickback voltage VK may be calculated using the measured kickback voltage VK when the temperature corresponds to the variations in the dielectric constant of the liquid crystal layer. However, as the kickback voltage VK increases, the variation of the kickback voltage VK also increases. Therefore, the temperature may be more precisely calculated than when the variation of the kickback voltage VK is small.

The temperature of the display panel 110 can be calculated using a kickback voltage that corresponds to the average value of the first and second kickback voltages, and thus display quality variations caused by temperature variations of the display panel 110 may be compensated.

Consequently, a display apparatus according to a present exemplary embodiment may compensate for display quality variation caused by the temperature variations, which may improve display quality of the display apparatus.

Figure 17:
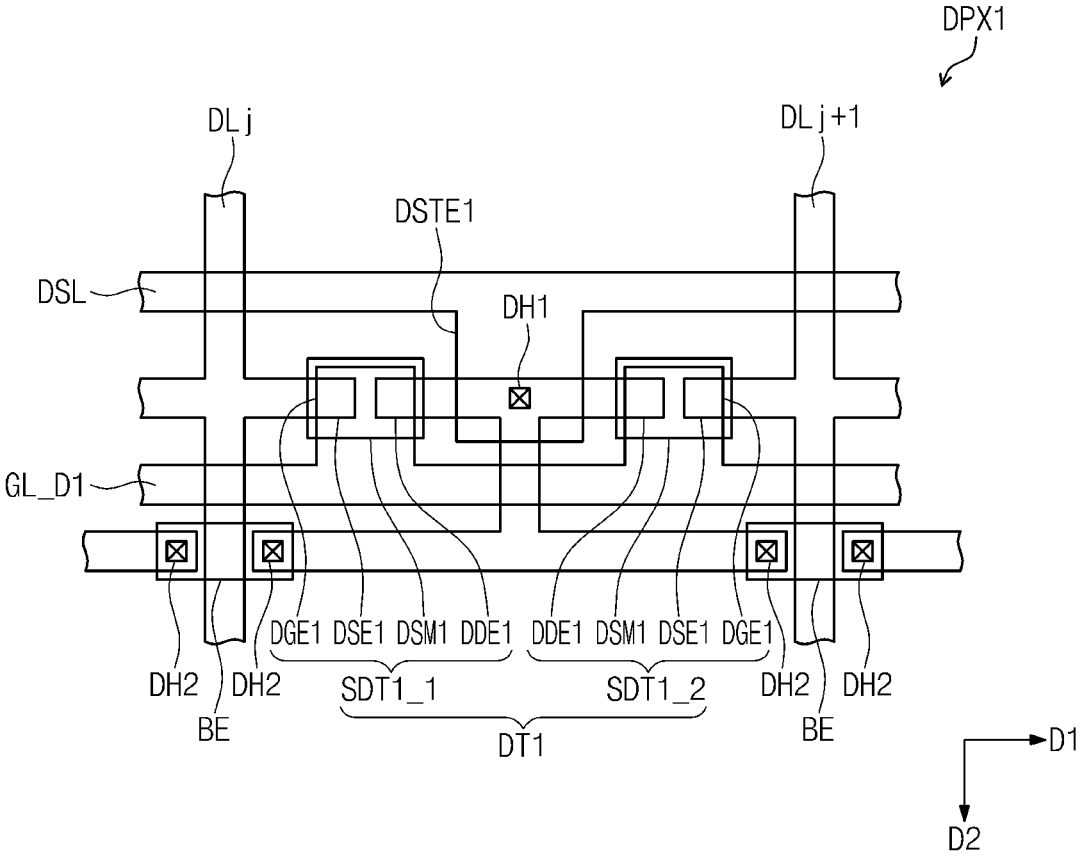
FIG. 17 is a view of a configuration of a first dummy pixel of a display apparatus according to another exemplary embodiment of the present disclosure.

FIG. 17 is a view of a configuration of a first dummy pixel of a display apparatus according to another exemplary embodiment of the present disclosure.

A display apparatus according to another exemplary embodiment has substantially the same structure as that of the display apparatus according to the embodiment of FIGS. 12-16 except for the first dummy pixel DPX.

Referring to FIG. 17, a first dummy transistor DT1 of the first dummy pixel DPX1 includes a plurality of first sub-dummy transistors SDT1_1 and SDT1_2 and a first dummy storage electrode DSTE1 that branches from the dummy storage line DSL.

The first sub-dummy transistors SDT1_1 and SDT1_2 include a first-first sub-dummy transistor SDT1_1 and a first-second sub-dummy transistor SDT1_2.

The first dummy gate electrodes DGE1 of the first-first and first-second sub-dummy transistors SDT1_1 and SDT1_2 branch from the first dummy gate line GL_D1.

The first dummy source electrode DSE1 of the first-first sub-dummy transistor SDT1_1 branches from a corresponding data line DLj. The first dummy source electrode DSE1 of the first-second sub-dummy transistor SDT1_2 branches from a corresponding data line DLj+1 adjacent to the data line DLj.

The first dummy drain electrodes DDE1 of the first-first and first-second sub-dummy transistors SDT1_1 and SDT1_2 are connected to each other and to the first dummy storage electrode DSTE1 through the first dummy contact hole DH1. The first dummy storage electrode DSTE1 branches from the dummy storage line DSL toward the first dummy gate electrodes DGE1 and comes between the first dummy gate electrodes DGE1.

In a present exemplary embodiment of the present disclosure, the dummy storage line DSL does not receive a common voltage. The first dummy storage electrode DSTE1 receives the corresponding data voltage through the turned-on first-first and first-second sub-dummy transistors SDT1_1 and SDT1_2. The configuration of the first dummy liquid crystal capacitor DCLC1 is substantially the same as that of the first dummy liquid crystal capacitor DCLC1 according to the exemplary embodiment of FIGS. 12-16.

The first dummy drain electrodes DDE1 of the first-first and first-second sub-dummy transistors SDT1_1 and SDT1_2 are connected to the first dummy drain electrodes DDE1 of an adjacent first dummy transistor DT1 through the bridge electrode BE, and are then connected to the first dummy output line DOL1.

Each of the first-first and first-second sub-dummy transistors SDT1_1 and SDT1_2 includes a first dummy semiconductor layer DSM1 that forms the conductive channel between the first dummy source electrode DSE1 and the first dummy drain electrode DDE1.

An area where the second dummy gate electrodes DGE2 of the second sub-dummy transistors SDT2 overlaps the second dummy source and drain electrodes DSE2 and DDE2 of the second sub-dummy transistors SDT2 is greater than an area where the gate electrode overlaps the source and drain electrodes of the pixel PX.

An area where the first dummy gate electrodes DGE1 overlap the first dummy source and drain electrodes DSE1 and DDE1 of the first-first and first-second sub-dummy transistors SDT1_1 and SDT1_2 is greater than an area where the gate electrode overlaps the source and drain electrodes of the pixel PX. Accordingly, the first kickback voltage of the first dummy pixel DPX1 is greater than the kickback voltage of each of the first and second dummy pixels DPX1 and DPX2 according to the exemplary embodiment of FIGS. 3-11.

As described above, the temperature of the display panel can be calculated using a kickback voltage that corresponds to an average of the first and second kickback voltages, and thus display quality variations caused by temperature variations of the display panel may be compensated.

Consequently, a display apparatus according to a present exemplary embodiment may compensate for the display quality variations caused by the temperature variations, which may improve the display quality of the display apparatus.

Figure 18:
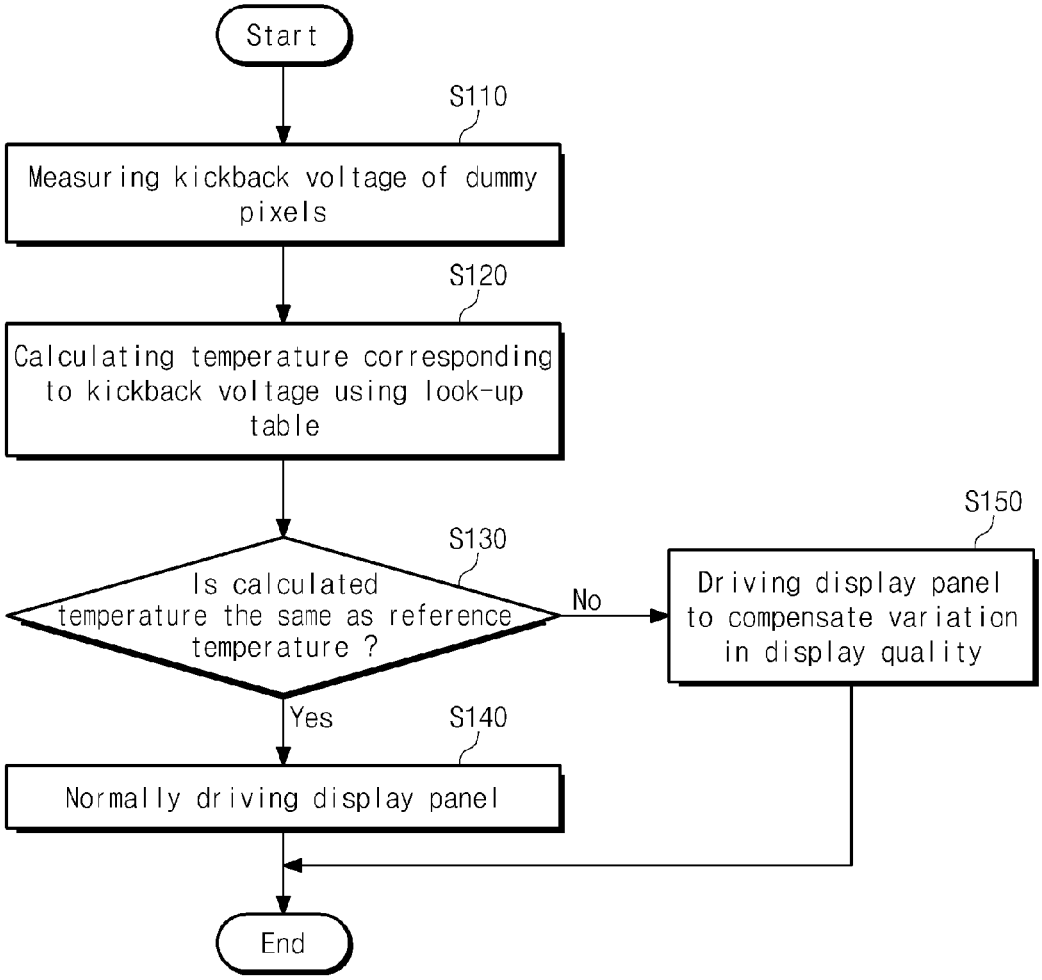
FIG. 18 is a flowchart of a method of driving a display apparatus according to an exemplary embodiment of the present disclosure.

FIG. 18 is a flowchart of a method of driving a display apparatus according to an exemplary embodiment of the present disclosure.

Referring to FIG. 18, the kickback voltage VK of the dummy pixels is measured (S110). The kickback voltage VK is converted to a digital signal.

The temperature corresponding to the kickback voltage is calculated using a look-up table that stores temperature values corresponding to the variations in the dielectric constant of the liquid crystal layer LC (S120). Accordingly, the temperature of the display panel 110 may be calculated.

The calculated temperature is compared with the reference temperature (S130). When the calculated temperature equals the reference temperature, the display apparatus 100 is operated normally (S140).

When the calculated temperature differs from the reference temperature, the display panel 110 is operated to compensate for the display quality variations caused by the temperature variation (S150). As described above, the gamma voltage VGMA, the image signals R', G', and B', and the common voltage VCOM are compensated and transmitted to the display panel 110 to compensate for the display quality variation due to the temperature variation. Therefore, since the pixels PX of the display panel 110 can be operated to compensate for display quality variations due to temperature variations, the display quality of the display apparatus 100 may be improved.

Although exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed.

What is claimed is:

1. A display apparatus comprising:

a display panel that comprises a plurality of pixels configured to receive data voltages in response to gate signals and a plurality of dummy pixels;

a driver configured to drive the pixels and the dummy pixels;

a kickback voltage detector circuit configured to detect a kickback voltage from the dummy pixels; and a timing controller configured to calculate a temperature corresponding to the kickback voltage, compare the calculated temperature with a reference temperature, and control the driver to compensate a display panel image quality based on a temperature variation that corresponds to a difference between the calculated temperature and the reference temperature, wherein said reference temperature corresponds to temperature at which the display panel normally displays an image and the same reference temperature is used for all subsequent comparisons with the calculated temperature.

2. The display apparatus of claim 1, wherein the display panel comprises a liquid crystal layer disposed between two substrates, the driver comprises a gate driver that transmits the gate signals to the pixels and the dummy pixels;

a data driver that generates the data voltages using image signals and a gamma voltage and transmits the data voltages to the pixels and the dummy pixels;

a gamma voltage generator that transmits the gamma voltage to the data driver; and a common voltage supply that transmits a common voltage to the pixels and the dummy pixels, and the timing controller comprises a look-up table configured to store temperature values that correspond to a variation in a dielectric constant of the liquid crystal layer, wherein the timing controller is configured to calculate the temperature corresponding to the kickback voltage using the look-up table, control the gamma voltage generator and the common voltage supply to compensate the gamma voltage and the common voltage based on the temperature variation, convert the image signals based on the temperature variation, and transmit the converted image signals to the data driver.

3. The display apparatus of claim 1, wherein the display panel further comprises:

a plurality of gate lines connected to the pixels and the dummy pixels, the plurality of gate lines being configured to receive the gate signals; and a plurality of data lines connected to the pixels and the dummy pixels, the plurality of data lines being configured to receive the data voltages.

4. The display apparatus of claim 3, wherein the dummy pixels comprise:

a plurality of first dummy pixels disposed in one first line extending in a first direction in a first dummy pixel area the first dummy pixel area being disposed adjacent to a first side of a display area in which the pixels are disposed;

a plurality of second dummy pixels disposed in one second line extending in a second direction perpendicular to the first direction in a second dummy pixel area, the second dummy pixel area being disposed adjacent to a second side of the display area perpendicular to the first side; and a black matrix disposed in the first and second dummy pixel areas to block light, wherein the pixels and the first and second dummy pixels have a same configuration and have a same kickback voltage.

5. The display apparatus of claim 4, wherein the gate lines comprise:

a plurality of first gate lines connected to the pixels;

a first dummy gate line connected to the first dummy pixels; and a second dummy gate line connected to the second dummy pixels, wherein the data lines comprise:

first data lines connected to the pixels and the second dummy pixels; and a dummy data line connected to the first dummy pixels, wherein the first gate lines are configured to receive sequentially transmitted gate signals, and the first and second dummy gate lines are configured to receive the gate signals with a same timing.

6. The display apparatus of claim 5, wherein each of the first and second dummy pixels comprises a dummy transistor; and a dummy liquid crystal capacitor connected to the dummy transistor, wherein a dummy pixel voltage charged in the dummy liquid crystal capacitor is transmitted to the kickback voltage detector circuit through a dummy output line, and the kickback voltage detector circuit detects a kickback voltage from the dummy pixel voltage.

7. The display apparatus of claim 6, wherein the dummy transistor of the first dummy pixel comprises:

a dummy gate electrode connected to the first dummy gate line;

a dummy source electrode connected to the dummy data line; and a dummy drain electrode connected to the dummy liquid crystal capacitor, wherein the dummy drain electrodes are connected to each other and to the dummy output line.

8. The display apparatus of claim 6, wherein the dummy transistor of the second dummy pixel comprises:

a dummy gate electrode connected to the second dummy gate line;

a dummy source electrode connected to a corresponding first data line; and a dummy drain electrode connected to the dummy liquid crystal capacitor, wherein the dummy drain electrodes are connected to each other and to the dummy output line.

9. The display apparatus of claim 6, wherein the dummy liquid crystal capacitor comprises:

a dummy pixel electrode connected to the dummy drain electrode, the dummy pixel electrode being configured to receive a corresponding data voltage;

a common electrode disposed to face the dummy pixel electrode, the common electrode being configured to receive the common voltage; and a liquid crystal layer disposed between the dummy pixel electrode and the common electrode.

10. The display apparatus of claim 3, wherein the dummy pixels comprise:

a plurality of first dummy pixels disposed in a first dummy pixel area that extends in a first direction; and a plurality of second dummy pixels disposed in second dummy pixel areas that extend in a second direction perpendicular to the first direction wherein the first dummy pixel area is disposed between the second dummy pixel areas, wherein the first and second dummy pixel areas are arranged in a cross shape, wherein a display area in which the pixels are disposed is divided into four areas by the first and second dummy pixel areas, the first dummy pixels are arranged in one first line, and the second dummy pixels are arranged in one second line perpendicular to the first line.

11. The display apparatus of claim 10, wherein the gate lines are configured to receive sequentially transmitted gate signals, wherein the gate lines comprise:

a plurality of first gate lines connected to the pixels;

a first dummy gate line connected to the first dummy pixels; and a second dummy gate line connected to the second dummy pixels, wherein the data lines comprise:

first data lines connected to the pixels; and a dummy data line connected to the second dummy pixels, wherein the first dummy pixels are connected to corresponding first data lines and a corresponding dummy data line.

12. The display apparatus of claim 11, wherein each of the first dummy pixels comprises:

a first dummy transistor, and a first dummy liquid crystal capacitor connected to the first dummy transistor, wherein each of the second dummy pixels comprises:

a second dummy transistor; and a second dummy liquid crystal capacitor connected to the second dummy transistor, wherein a capacitance of each of the first and second dummy liquid crystal capacitors is smaller than a capacitance of a liquid crystal capacitor of each of the pixels.

13. The display apparatus of claim 12, wherein a first dummy pixel voltage charged in the first dummy liquid crystal capacitor is transmitted to the kickback voltage detector circuit through a first dummy output line, a second dummy pixel voltage charged in the second dummy liquid crystal capacitor is transmitted to the kickback voltage detector circuit through a second dummy output line, the kickback voltage detector circuit detects a first kickback voltage from the first dummy pixel voltage and a second kickback voltage from the second dummy pixel voltage and outputs an average of the first and second kickback voltages as the kickback voltage, and the first and second kickback voltages are each greater than the kickback voltage of each of the pixels.

14. The display apparatus of claim 12, wherein the first dummy transistor comprises:

a first dummy gate electrode connected to the first dummy gate line;

a first dummy source electrode connected to a corresponding data line and the dummy data line; and a first dummy drain electrode connected to the first dummy liquid crystal capacitor, wherein the first dummy liquid crystal capacitor comprises:

a first dummy storage electrode disposed on a same layer as the first dummy gate electrode that branches from a dummy storage line and connects to the first dummy drain electrode;

a common electrode disposed to face the first dummy storage electrode that receives a common voltage; and a liquid crystal layer disposed between the first dummy storage electrode and the common electrode, wherein the first dummy storage electrode receives a corresponding data voltage through the first dummy transistor, and the first dummy drain electrodes are commonly connected to the first dummy output line to he connected to each other.

15. The display apparatus of claim 12, wherein the second dummy transistor comprises a plurality of second sub-dummy transistors, each of the second sub-dummy transistors comprises:

a second dummy gate electrode connected to the second dummy gate line;

a second dummy source electrode connected to the second dummy data line; and a second dummy drain electrode connected to the second dummy liquid crystal capacitor, wherein the second dummy liquid crystal capacitor comprises:

a dummy liquid crystal electrode that branches from the second dummy drain electrode;

a common electrode disposed to face the dummy liquid crystal electrode and configured to receive a common voltage; and a liquid crystal layer disposed between the first dummy storage electrode and the common electrode, wherein the second dummy drain electrodes are connected to each other and to the second dummy output line.

16. The display apparatus of claim 12, wherein the first dummy transistor further comprises a first-first sub-dummy transistor and a first-second sub-dummy transistor, wherein each of the first-first and first-second sub-dummy transistors comprises:

a first dummy gate electrode connected to the first dummy gate line;

a first dummy source electrode that branches from a corresponding data line of two adjacent data lines; and a first dummy drain electrode that connects to the first dummy liquid crystal capacitor, wherein the first dummy liquid crystal capacitor comprises:

a first dummy storage electrode disposed on a same layer as the first dummy gate electrode and that branches from a dummy storage line and connects to the first dummy drain electrode;

a common electrode disposed to face the first dummy storage electrode and configured to receive a common voltage; and a liquid crystal layer disposed between the first dummy storage electrode and the common electrode, wherein the first dummy storage electrode receives a corresponding data voltage through the first dummy transistor, and the first dummy drain electrodes are connected to each other and to the first dummy output line.

17. A method of driving a display apparatus, comprising:

receiving data voltages in response to gate signals to drive a plurality of pixels and a plurality of dummy pixels disposed on a display panel;

detecting a kickback voltage from the dummy pixels;

calculating a temperature that corresponds to the kickback voltage;

comparing the calculated temperature with a reference temperature; and driving the pixels to compensate a display panel image quality based on a temperature variation corresponding to a difference between the calculated temperature and the reference temperature, wherein said reference temperature corresponds to temperature at which the display panel normally displays an image and the same reference temperature is used for all subsequent comparisons with the calculated temperature.

18. The method of claim 17, wherein the display apparatus comprises a liquid crystal layer disposed between two substrates, wherein driving the pixels and the dummy pixels comprises:

generating the data voltages using image signals and a gamma voltage;

transmitting the data voltages to the pixels and the dummy pixels; and transmitting a common voltage to the pixels and the dummy pixels, wherein calculating the temperature corresponding to the kickback voltage comprises using a look-up table that stores temperature values corresponding to a variation in a dielectric constant of the liquid crystal layer, and wherein driving the pixels comprises compensating the gamma voltage and the common voltage based on the temperature variation, converting the image signals, and transmitting the converted image signals to the pixels.

19. A display apparatus comprising:

a display panel that comprises a plurality of pixels, a plurality of dummy pixels, and a liquid crystal layer disposed between two substrates;

a driver configured to generate data voltages using image signals and a gamma voltage and transmit the data voltages and a common voltage to the pixels and the dummy pixels; and a timing controller configured to calculate a temperature of the liquid crystal layer, compare the calculated temperature with a reference temperature to calculate a temperature variation, compensate the gamma voltage and the common voltage based on the temperature variation, convert the image signals based on the temperature variation, and transmit the converted image signals to the driver, wherein said reference temperature corresponds to temperature at which the display panel normally displays an image and the same reference temperature is used for all subsequent comparisons with the calculated temperature.

20. The display apparatus of claim 19, further comprising:

a gate driver that applies the gate signals to the pixels and the dummy pixels, wherein the plurality of pixels are configured to receive data voltages in response to gate signals; and a kickback voltage detector circuit configured to detect a kickback voltage from the dummy pixels, wherein the kickback voltage corresponds to a dielectric constant of the liquid crystal layer, and the dielectric constant corresponds to the temperature of the liquid crystal layer, wherein the driver comprises a data driver that generates the data voltages using image signals and the gamma voltage and transmits the data voltages to the pixels and the dummy pixels, a gamma voltage generator that transmits the gamma voltage to the data driver, and a common voltage supply that transmits the common voltage to the pixels and the dummy pixels, and wherein the timing controller comprises a look-up table configured to store temperature values that correspond to a variation in the dielectric constant of the liquid crystal layer, calculates the temperature corresponding to the kickback voltage using the look-up table, and controls the gamma voltage generator and the common voltage supply to compensate the gamma voltage and the common voltage based on the temperature variation.

* * * * *